US009587477B2

(12) United States Patent
Lafferty et al.

(10) Patent No.: US 9,587,477 B2
(45) Date of Patent: Mar. 7, 2017

(54) WELL TREATMENT WITH UNTETHERED AND/OR AUTONOMOUS DEVICE

(71) Applicant: Schlumberger Technology Corporation, Sugar Land, TX (US)

(72) Inventors: Ted Lafferty, Sugar Land, TX (US); Matthew J. Miller, Katy, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 122 days.

(21) Appl. No.: 14/043,125

(22) Filed: Oct. 1, 2013

(65) Prior Publication Data

US 2015/0060064 A1 Mar. 5, 2015

Related U.S. Application Data

(63) Continuation-in-part of application No. 14/016,571, filed on Sep. 3, 2013.

(51) Int. Cl.
*E21B 43/267* (2006.01)
*E21B 34/14* (2006.01)

(52) U.S. Cl.
CPC ..... *E21B 43/267* (2013.01); *E21B 34/14* (2013.01)

(58) Field of Classification Search
CPC ..... E21B 43/267; E21B 43/26; E21B 43/25; E21B 43/114; E21B 43/025; E21B 43/261; C09K 8/68; C09K 8/80; C09K 8/805; C09K 8/62
See application file for complete search history.

(56) References Cited

U.S. PATENT DOCUMENTS

| | | | |
|---|---|---|---|
| 3,011,548 | A | 12/1961 | Holt |
| 3,054,415 | A | 9/1962 | Baker et al. |
| 3,263,752 | A | 8/1966 | Conrad |
| 3,269,463 | A | 8/1966 | Page, Jr. |
| 3,995,692 | A | 12/1976 | Seitz |
| 4,064,937 | A | 12/1977 | Barrington |

(Continued)

FOREIGN PATENT DOCUMENTS

| | | | |
|---|---|---|---|
| WO | 03095794 | A1 | 11/2003 |
| WO | 2004088091 | A1 | 10/2004 |

(Continued)

OTHER PUBLICATIONS

Thomson, D. W., and Nazroo, M. F., "Design and Installation of a Cost-Effective Completion System for Horizontal Chalk Wells Where Multiple Zones Require Acid Stimulation," (a revision of SPE 39150), first presented at the Offshore Technology Conference, Houston, TX, USA, May 5-8, 1997, SPE 51177, pp. 151-156, Offshore Technology Conference.

(Continued)

*Primary Examiner* — Zakiya W Bates
(74) *Attorney, Agent, or Firm* — Andrea E. Tran

(57) ABSTRACT

Well treatment with an untethered and/or autonomous device. Also, in situ channelization treatment fluids are used in multistage well treatment with an untethered and/or autonomous device; and methods and/or systems for treating a subterranean formation penetrated by a wellbore, relating to in situ channelization treatment fluids, which may optionally be energized, and untethered and/or autonomous devices.

36 Claims, 19 Drawing Sheets

(56) References Cited

U.S. PATENT DOCUMENTS

| | | | |
|---|---|---|---|
| 4,355,686 | A | 10/1982 | Arendt |
| 4,729,432 | A | 3/1988 | Helms |
| 4,771,831 | A | 9/1988 | Pringle et al. |
| 5,183,114 | A | 2/1993 | Mashaw, Jr. et al. |
| 5,224,044 | A | 6/1993 | Tamura et al. |
| 5,295,393 | A | 3/1994 | Thiercelin |
| 5,333,692 | A | 8/1994 | Baugh et al. |
| 5,518,996 | A | 5/1996 | Maroy et al. |
| 5,526,888 | A | 6/1996 | Gazewood |
| 5,905,468 | A | 5/1999 | Ikawa et al. |
| 5,921,318 | A | 7/1999 | Ross |
| 5,988,285 | A | 11/1999 | Tucker et al. |
| 6,006,838 | A | 12/1999 | Whiteley et al. |
| 6,059,032 | A | 5/2000 | Jones |
| 6,145,378 | A | 11/2000 | McRobbie et al. |
| 6,155,342 | A | 12/2000 | Oneal et al. |
| 6,206,095 | B1 | 3/2001 | Baugh |
| 6,216,785 | B1 | 4/2001 | Achee, Jr. et al. |
| 6,302,199 | B1 | 10/2001 | Hawkins et al. |
| 6,334,486 | B1 | 1/2002 | Carmody et al. |
| 6,371,208 | B1 | 4/2002 | Norman et al. |
| 6,443,228 | B1 | 9/2002 | Aronstam et al. |
| 6,543,538 | B2 | 4/2003 | Tolman et al. |
| 6,599,863 | B1 | 7/2003 | Palmer et al. |
| 6,634,429 | B2 | 10/2003 | Henderson et al. |
| 6,776,235 | B1 * | 8/2004 | England ..... 166/271 |
| 6,820,694 | B2 | 11/2004 | Willberg et al. |
| 6,843,317 | B2 | 1/2005 | Mackenzie |
| 6,845,819 | B2 | 1/2005 | Barrett et al. |
| 6,907,936 | B2 | 6/2005 | Fehr et al. |
| 6,953,094 | B2 | 10/2005 | Ross et al. |
| 6,997,263 | B2 | 2/2006 | Campbell et al. |
| 7,066,265 | B2 | 6/2006 | Surjaatmadja |
| 7,093,664 | B2 | 8/2006 | Todd et al. |
| 7,108,067 | B2 | 9/2006 | Themig et al. |
| 7,134,505 | B2 | 11/2006 | Fehr et al. |
| 7,150,318 | B2 | 12/2006 | Freeman |
| 7,168,494 | B2 | 1/2007 | Starr et al. |
| 7,210,533 | B2 | 5/2007 | Starr et al. |
| 7,275,596 | B2 | 10/2007 | Willberg et al. |
| 7,322,417 | B2 | 1/2008 | Rytlewski et al. |
| 7,325,617 | B2 | 2/2008 | Murray |
| 7,353,879 | B2 | 4/2008 | Todd et al. |
| 7,377,321 | B2 | 5/2008 | Rytlewski |
| 7,380,601 | B2 | 6/2008 | Willberg et al. |
| 7,387,165 | B2 | 6/2008 | Lopez de Cardenas et al. |
| 7,431,091 | B2 | 10/2008 | Themig et al. |
| 7,464,764 | B2 | 12/2008 | Xu |
| 7,490,669 | B2 | 2/2009 | Walker et al. |
| 7,543,634 | B2 | 6/2009 | Fehr et al. |
| 7,543,647 | B2 | 6/2009 | Walker |
| 7,552,779 | B2 | 6/2009 | Murray |
| 7,571,765 | B2 | 8/2009 | Themig |
| 7,575,062 | B2 | 8/2009 | East, Jr. |
| 7,661,481 | B2 | 2/2010 | Todd et al. |
| 7,665,522 | B2 | 2/2010 | Sullivan et al. |
| 7,703,507 | B2 | 4/2010 | Strickland |
| 7,703,510 | B2 | 4/2010 | Xu |
| 7,748,460 | B2 | 7/2010 | Themig et al. |
| 7,784,541 | B2 | 8/2010 | Hartman et al. |
| 7,789,146 | B2 | 9/2010 | Panga et al. |
| 7,798,224 | B2 | 9/2010 | Huang et al. |
| 7,832,472 | B2 | 11/2010 | Themig |
| 7,833,950 | B2 | 11/2010 | Willberg et al. |
| 7,891,774 | B2 | 2/2011 | Silverbrook |
| 7,931,089 | B2 | 4/2011 | Miller et al. |
| 8,008,234 | B2 | 8/2011 | Panga et al. |
| 8,042,614 | B2 | 10/2011 | Sullivan et al. |
| 8,119,574 | B2 | 2/2012 | Panga et al. |
| 8,191,629 | B2 | 6/2012 | Gordon et al. |
| 8,210,249 | B2 | 7/2012 | Panga et al. |
| 8,227,026 | B2 | 7/2012 | McDaniel et al. |
| 8,230,925 | B2 | 7/2012 | Willberg et al. |
| 8,234,072 | B2 | 7/2012 | Smith, Jr. et al. |
| 8,372,787 | B2 | 2/2013 | Droger |
| 2002/0074128 | A1 | 6/2002 | Allamon |
| 2003/0180094 | A1 | 9/2003 | Madison |
| 2004/0118564 | A1 | 6/2004 | Themig et al. |
| 2004/0262016 | A1 | 12/2004 | Farquhar |
| 2006/0124310 | A1 | 6/2006 | Lopez de Cardenas et al. |
| 2006/0207764 | A1 | 9/2006 | Rytlewski |
| 2006/0243455 | A1 | 11/2006 | Telfer et al. |
| 2007/0044958 | A1 | 3/2007 | Rytlewski et al. |
| 2007/0107908 | A1 | 5/2007 | Vaidya et al. |
| 2007/0181224 | A1 | 8/2007 | Marya et al. |
| 2007/0272411 | A1 | 11/2007 | Lopez De Cardenas |
| 2007/0272413 | A1 | 11/2007 | Rytlewski et al. |
| 2007/0284097 | A1 | 12/2007 | Swor et al. |
| 2008/0105438 | A1 | 5/2008 | Jordan et al. |
| 2008/0196896 | A1 | 8/2008 | Bustos et al. |
| 2008/0210429 | A1 | 9/2008 | McMillin et al. |
| 2009/0025934 | A1 | 1/2009 | Hartman et al. |
| 2009/0114392 | A1 | 5/2009 | Tolman et al. |
| 2009/0260814 | A1 * | 10/2009 | Malone ..... 166/276 |
| 2010/0101803 | A1 | 4/2010 | Clayton et al. |
| 2010/0132954 | A1 | 6/2010 | Telfer |
| 2010/0209288 | A1 | 8/2010 | Marya |
| 2010/0300688 | A1 | 12/2010 | Panga et al. |
| 2010/0307737 | A1 | 12/2010 | Mellemstrand et al. |
| 2011/0056692 | A1 | 3/2011 | Lopez De Cardenas et al. |
| 2011/0098202 | A1 | 4/2011 | James et al. |
| 2011/0114313 | A1 * | 5/2011 | Lesko et al. ..... 166/280.1 |
| 2011/0127047 | A1 | 6/2011 | Themig et al. |
| 2011/0240293 | A1 | 10/2011 | Lesko et al. |
| 2011/0240301 | A1 | 10/2011 | Robison |
| 2011/0240311 | A1 | 10/2011 | Robison |
| 2011/0278010 | A1 | 11/2011 | Fehr et al. |
| 2011/0284240 | A1 | 11/2011 | Chen et al. |
| 2012/0000641 | A1 | 1/2012 | Panga et al. |
| 2012/0085538 | A1 | 4/2012 | Guerrero et al. |
| 2012/0111563 | A1 | 5/2012 | Abad et al. |
| 2012/0132421 | A1 | 5/2012 | Loiseau et al. |
| 2012/0138296 | A1 | 6/2012 | Panga et al. |
| 2012/0305245 | A1 | 12/2012 | Loiseau et al. |
| 2012/0305254 | A1 | 12/2012 | Chen et al. |
| 2013/0062055 | A1 | 3/2013 | Tolman et al. |
| 2013/0112435 | A1 | 5/2013 | Fleming et al. |
| 2013/0233542 | A1 | 9/2013 | Shampine et al. |
| 2013/0324444 | A1 | 12/2013 | Lesko et al. |

FOREIGN PATENT DOCUMENTS

| | | |
|---|---|---|
| WO | WO2011050046 | 4/2011 |
| WO | WO2012054456 | 4/2012 |
| WO | WO2012069541 | 5/2012 |
| WO | WO2012082302 | 6/2012 |
| WO | WO2012154932 | 11/2012 |
| WO | WO2013085412 | 6/2013 |

OTHER PUBLICATIONS

Lonnes, et al., "Advanced Multizone Stimulation Technology," presented at the 2005 SPE Annual Technical Conference and Exhibition, Dallas, TX, USA, Oct. 9-12, 2005, SPE 95778, 7 pages, Society of Petroleum Engineers.

Rytlewski, G., "Multiple-Layer Completions for Efficient Treatment of Multilayer Reservoirs," Presented at the 2008 IADC/SPE Drilling Conference, Orlando, FL, USA, Mar. 4-6, 2008, IADC/SPE 112476, 8 pages, IADC/SPE Drilling Conference.

The unpublished specification and drawings of U.S. Appl. No. 13/832,938 as filed, Specification is 30 pages total and drawings are 8 pages total, 2013.

Potapenko, et al.,"Barnett Shale Refracture Stimulations Using a Novel Diversion Technique," presented at the 2009 SPE Hydraulic Fracturing Technology Conference, The Woodlands, Texas, USA, Jan. 19-21, 2009, SPE 119636, 11 pages, Society of Petroleum Engineers.

Taylor, "The Dispersion of Matter in Turbulent Flow through a Pipe," 1954, Proceedings of the Royal Society of London, pp. 446-468, vol. 223, The Royal Society.

(56) References Cited

OTHER PUBLICATIONS

Taylor, "Dispersion of Soluble Matter in Solvent Flowing Slowly Through a Tube," Aug. 25, 1953, Proceedings of the Royal Society of London. Series A, Mathematical and Physical Sciences, pp. 186-203, vol. 219, No. 1137.
International Search Report and Written Opinion issued in PCT/US2014/051294 on Dec. 23, 2014, 19 pages.

* cited by examiner

WELL TREATMENT WITH UNTETHERED AND/OR AUTONOMOUS DEVICE

RELATED APPLICATION DATA

This application is a continuation-in-part of copending U.S. Ser. No. 14/016,571, filed Sep. 3, 2013.

BACKGROUND

The statements in this section merely provide background information related to the present disclosure and may not constitute prior art.

In wells employing multistage hydraulic fracturing stage tools, a fracturing port is usually opened by sliding a sleeve, permitting injected fracturing fluids to escape the wellbore and create a fracture in the surrounding formation. The device that shifts the sleeve is a ball, a dart, or even a length of tubing inserted into the wellbore. The device travels (or is inserted) up to the point where the device is captured by a capture feature on the stage tool, such as a collet, lever, cavity, etc., and further device motion pushes the sleeve open. Some representative multistage hydraulic fracturing stage tools are disclosed in U.S. Pat. Nos. 7,387,165, 7,322,417, 7,377,321, US20070107908, US20070044958, US20100209288, U.S. Pat. No. 7,387,165, US2009/0084553, U.S. Pat. Nos. 7,108,067, 7,431,091, 6,907,936, 7,543,634, 7,134,505, 7,021,384, 7,353,878, 7,267,172, 7,681,645, 7,703,510, 7,784,543, 7,628,210, WO2012083047, U.S. Pat. Nos. 7,066,265, 7,168,494, 7,353,879, 7,093,664, 7,210,533, 7,343,975, 7,431,090, 7,571,766, 8,104,539, and US2010/0044041, U.S. Pat. Nos. 8,066,069, 6,866,100, 8,201,631; US20120090847; US20110198082; US20080264636, which are hereby incorporated herein by reference.

Fracturing is used to increase permeability of subterranean formations. A fracturing fluid is injected into the wellbore passing through the subterranean formation. A propping agent (proppant) is injected into the fracture to prevent fracture closing and, thereby, to provide improved extraction of extractive fluids, such as oil, gas or water.

The proppant maintains the distance between the fracture walls in order to create conductive channels in the formation. It is known that heterogeneous placement through pulsing of proppant enable to create pillars improving the conductivity of the fracture and thus enabling a higher productivity of the wells; however, such a process is generally difficult to control when involving multistage completion tools.

Such multistage tools enable a reduction of non-productive time and thus the industry would welcome a system enabling the formation of pillars and/or cluster when using multistage completion tools.

SUMMARY

In some embodiments herein, the treatments, treatment fluids, systems, equipment, methods, and the like employ an in situ method and system for increasing fracture conductivity. In embodiments, a treatment slurry stage has a solid particulates concentration and a concentration of an additive that facilitates clustering of the solid particulates in the fracture, anchoring of the clusters in the fracture, or a combination thereof, to form anchored clusters of the solid particulates to prop open the fracture upon closure and provide hydraulic conductivity through the fracture following closure, such as, for example, by forming interconnected, hydraulically conductive channels between the clusters.

In some embodiments according to the instant disclosure a method comprises: placing in a wellbore adjacent a subterranean formation a downhole completion staging system production liner fitted with a plurality of sliding sleeves in the closed position; placing into the wellbore a downhole completion staging system tool comprising a sleeve-shifting device, using an in situ channelization treatment fluid as a medium to transport the downhole completion staging system tool; translating the downhole completion staging system tool into a capture feature of the downhole completion staging system to operate one or more of the sliding sleeves to open one or more fracturing ports for fluid communication between the wellbore and the subterranean formation in one of a plurality of wellbore stages spaced along the wellbore; isolating the one of the wellbore stages for treatment; injecting the in situ channelization treatment fluid through the wellbore and the one or more fracturing ports of the isolated wellbore stage to place particulate clusters in a fracture in the subterranean formation; and repeating the isolation and particulate clusters placement to treat one or more additional stages.

In some embodiments, the translation of the downhole completion staging system tool uses the in situ channelization treatment fluid as a transport medium. In some embodiments, the in situ channelization treatment fluid is circulated through the fracturing port and into the formation to create the fracture.

In some embodiments, the method may further comprise radially expanding the downhole completion staging system tool to form a plug between at least two stages.

In some embodiments, the downhole completion staging system tool comprises an untethered object, and the method may further comprise sensing a property of an environment of the downhole completion staging system production liner, wherein the operation of the downhole completion staging system tool to open the one or more fracturing ports is autonomous in response to the sensing. In some embodiments, the untethered object comprises a dart.

In some embodiments, the in situ channelization treatment fluid comprises a carrier fluid, proppant and an anchorant. In some embodiments, the in situ channelization treatment fluid comprises a viscosified carrier fluid and a breaker to induce settling of the solid particulates prior to closure of the fracture. In some embodiments, the in situ channelization treatment fluid is energized.

In some embodiments, the method may further comprise terminating treatment of the one or more stages with injection of a volume of a terminal flushing fluid substage substantially free of particles prior to treatment of a successive one of the additional stages, wherein the volume of the terminal flushing fluid substage is less than a volume of a flow path in the wellbore to the one or more stages. In some embodiments, the volume of the terminal flushing fluid substage is substantially less than the volume of the flow path. In some embodiments, the method may be free of overflushing.

In some embodiments, a method comprises: pushing an untethered object in a wellbore with an in situ channelization treatment fluid comprising proppant and anchorant; autonomously operating the untethered object to sense a downhole location to transition the untethered object from a first state to a second state in response to the sensing; triggering an activating feature of a downhole completion staging system responsive to the second transition state of the untethered object to open one or more fracturing ports for fluid communication between the wellbore and a subterranean formation in one of a plurality of wellbore stages spaced along the wellbore; isolating the one of the wellbore stages for treatment; injecting the in situ channelization treatment fluid through the opened one or more fracturing ports of the isolated wellbore stage to place particulate clusters in a fracture in the subterranean formation; and repeating the isolation and particulate clusters placement for one or more additional stages.

In some embodiments, the first state comprises a radially contracted state and the second state comprises a radially expanded state. In some embodiments, the activating feature may comprise a capture feature and/or the isolation may comprise forming a plug with the untethered object, which may be a dart, in the radially expanded state.

In some embodiments, the in situ channelization treatment fluid is circulated through the fracturing port and into the formation to create the fracture. In some embodiments, the triggering of the activating feature of the downhole completion staging system to open the one or more fracturing ports comprises operating a sliding sleeve.

In some embodiments, the in situ channelization treatment fluid comprises a carrier fluid, proppant and an anchorant, and wherein the in situ channelization treatment fluid may optionally be energized.

In some embodiments, the method may further comprise producing a reservoir fluid from the fractures in the subterranean formation, wherein a production efficiency is at least 70 percent, wherein production efficiency is taken as a ratio of the number of producing wellbore treatment stages to a total number of wellbore treatment stages.

In some further embodiments, a downhole completion staging system comprises: a wellbore penetrating a subterranean formation and comprising a production liner fitted with a plurality of sliding sleeves; a pumping system to inject an in situ channelization treatment fluid into the wellbore; a plurality of completion staging system tools for deployment into the wellbore with the in situ channelization treatment fluid, the completion staging system tools comprising a sleeve-shifting device; the sliding sleeve valves each comprising a capture feature to receive a respective one of the completion staging system tools to open one or more fracturing ports for fluid communication between the wellbore and the subterranean formation in one of a plurality of wellbore stages spaced along the wellbore; a plurality of plugs operable to successively isolate respective ones of the wellbore stages for treatment comprising injecting the in situ channelization treatment fluid through the one or more fracturing ports of the isolated wellbore stage to place particulate clusters in fractures in the subterranean formation in a plurality of the stages.

In some embodiments, the in situ channelization treatment fluid may be or comprise a transport medium for the completion staging system tools.

In some embodiments, the downhole completion staging system tools are radially expandable to form the plugs.

In some embodiments, the downhole completion staging system tools comprise untethered objects comprising sensors to sense a property of an environment of the production liner, wherein the downhole completion staging system tools are operable to autonomously open the fracturing ports in response to the sensing. In some embodiments, the untethered objects comprise darts. In some embodiments, the downhole completion staging system tools are connected to a wireline to relay information from the tool to surface.

In some embodiments, the in situ channelization treatment fluid comprises a carrier fluid, proppant and an anchorant. In some embodiments, the in situ channelization treatment fluid comprises a viscosified carrier fluid and a breaker to induce settling of the solid particulates prior to closure of the fracture. In some embodiments, the in situ channelization treatment fluid is energized.

In some embodiments, the system may further comprise a plurality of volumes of a terminal flushing fluid substage substantially free of particles, wherein the volume of each terminal flushing fluid substage is less than a volume of a flow path in the wellbore to the one or more stages. In some embodiments, the volumes of the terminal flushing fluid substages are each substantially less than the volume of the flow path.

In some further embodiments, a system comprises: an object deployed in a wellbore with an in situ channelization treatment fluid comprising proppant and anchorant; a sensor in the object to autonomously operate the object to sense a downhole location to transition the object from a first state to a second state in response to the sensing; an activating feature of a downhole completion staging system responsive to be triggered by the second transition state of the object to open one or more fracturing ports for fluid communication between the wellbore and a subterranean formation in one of a plurality of wellbore stages spaced along the wellbore; the object comprising an isolation feature to isolate the one of the wellbore stages for treatment; a pumping system to inject the in situ channelization treatment fluid through the opened one or more fracturing ports of the isolated wellbore stage to place particulate clusters in a fracture in the subterranean formation; and an additional one or more of the objects to repeat the isolation and particulate clusters placement for a respective one or more additional stages.

In some embodiments, the object comprises an untethered object, which may comprise a dart, for example, wherein the first state comprises a radially contracted state and the second state comprises a radially expanded state. In some embodiments, the activating feature comprises a capture feature and the isolation feature comprises a plug formed by the untethered object or dart in the radially expanded state.

In some embodiments, the system may comprise a plurality of the fractures formed by injecting the in situ channelization treatment fluid with the pumping system through the fracturing port and into the formation.

In some embodiments, the activating feature to open the one or more fracturing ports may comprise a sliding sleeve.

In some embodiments, the in situ channelization treatment fluid comprises a carrier fluid, proppant and an anchorant. In some embodiments, the in situ channelization treatment fluid is energized.

In some embodiments, the system may be installed to produce a reservoir fluid from the fractures in the subterranean formation from a plurality of the wellbore treatment stages. In some embodiments, the installed system may comprise a production efficiency of at least 70 percent, wherein production efficiency is taken as a ratio of the number of producing wellbore treatment stages to a total number of wellbore treatment stages.

BRIEF DESCRIPTION OF THE DRAWINGS

These and other features and advantages will be better understood by reference to the following detailed description when considered in conjunction with the accompanying drawings.

FIG. 22 schematically illustrates the proppant slurry profile after placement into a hydraulic fracture but before destabilization.

DETAILED DESCRIPTION OF SOME ILLUSTRATIVE EMBODIMENTS

Figure 1:
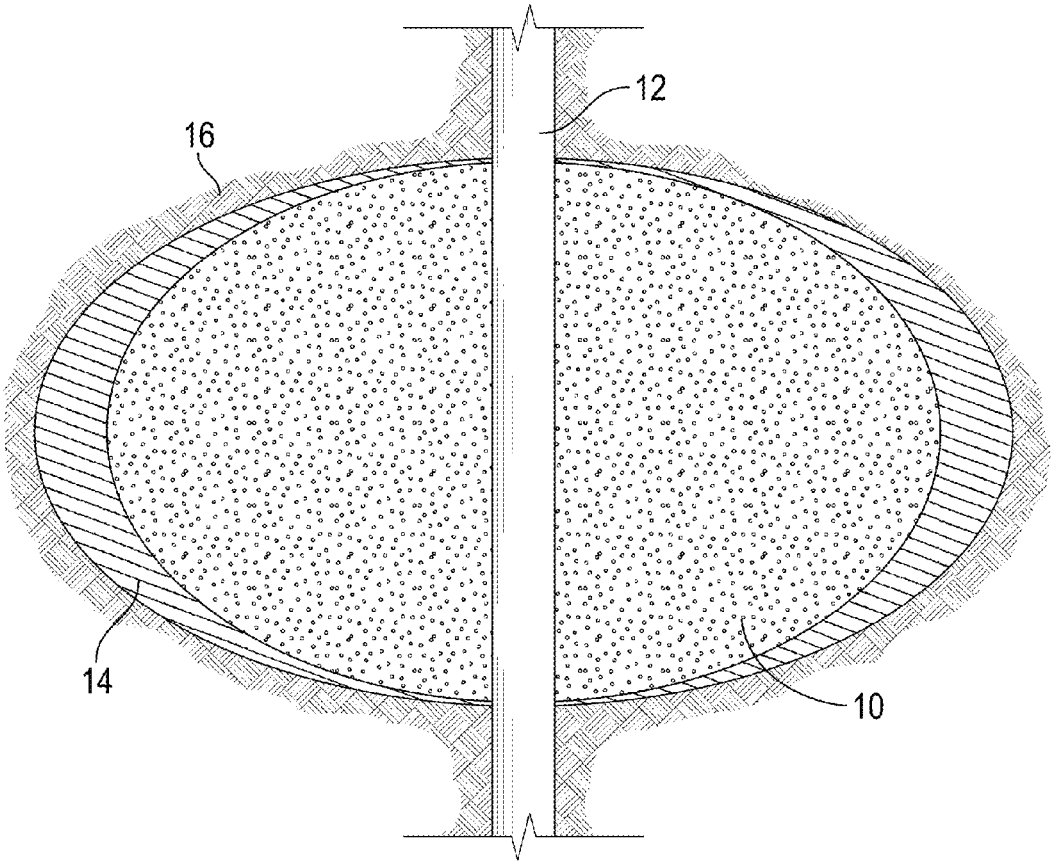
FIG. 1 schematically illustrates a proppant slurry profile after placement into a hydraulic fracture but before destabilization according to some embodiments of the present disclosure.

For the purposes of promoting an understanding of the principles of the disclosure, reference will now be made to some illustrative embodiments of the current application. Like reference numerals used herein refer to like parts in the various drawings. Reference numerals without suffixed letters refer to the part(s) in general; reference numerals with suffixed letters refer to a specific one of the parts.

As used herein, "embodiments" refers to non-limiting examples of the application disclosed herein, whether claimed or not, which may be employed or present alone or in any combination or permutation with one or more other embodiments. Each embodiment disclosed herein should be regarded both as an added feature to be used with one or more other embodiments, as well as a further embodiment to be used separately or in lieu of one or more other embodiments. It should be understood that no limitation of the scope of the claimed subject matter is thereby intended, any alterations and further modifications in the illustrated embodiments, and any further applications of the principles of the application as illustrated therein as would normally occur to one skilled in the art to which the disclosure relates are contemplated herein.

Moreover, the schematic illustrations and descriptions provided herein are understood to be examples only, and components and operations may be combined or divided, and added or removed, as well as re-ordered in whole or part, unless stated explicitly to the contrary herein. Certain operations illustrated may be implemented by a computer executing a computer program product on a computer readable medium, where the computer program product comprises instructions causing the computer to execute one or more of the operations, or to issue commands to other devices to execute one or more of the operations.

As used herein, the term hydraulic fracturing, hydraulic fracturing treatment or hydraulic fracturing operation means the process of pumping fluid into a wellbore, e.g. using powerful hydraulic pumps to create enough downhole pressure to crack or fracture the formation. This allows injection of proppant-laden fluid into the formation, thereby creating a region of high-permeability sand through which fluids can flow. The proppant remains in place once the hydraulic pressure is removed and therefore proppants open the fracture and enhances flow into or from the wellbore.

In some embodiments according to the disclosure herein, an in situ method and system are provided for increasing fracture conductivity. By "in situ" is meant that channels of relatively high hydraulic conductivity are formed in a fracture after it has been filled with a generally uniform distribution of proppant particles. As used herein, a "hydraulically conductive fracture" is one which has a high conductivity relative to the adjacent formation matrix, whereas the term "conductive channel" refers to both open channels as well as channels filled with a matrix having interstitial spaces for permeation of fluids through the channel, such that the channel has a relatively higher conductivity than adjacent non-channel areas.

The term "continuous" in reference to concentration or other parameter as a function of another variable such as time, for example, means that the concentration or other parameter is an uninterrupted or unbroken function, which may include relatively smooth increases and/or decreases with time, e.g., a smooth rate or concentration of proppant particle introduction into a fracture such that the distribution of the proppant particles is free of repeated discontinuities and/or heterogeneities over the extent of proppant particle filling. In some embodiments, a relatively small step change in a function is considered to be continuous where the change is within +/−10% of the initial function value, or within +/−5% of the initial function value, or within +/−2% of the initial function value, or within +/−1% of the initial function value, or the like over a period of time of 1 minute, 10 seconds, 1 second, or 1 millisecond. The term "repeated" herein refers to an event which occurs more than once in a stage.

Conversely, a parameter as a function of another variable such as time, for example, is "discontinuous" wherever it is not continuous, and in some embodiments, a repeated relatively large step function change is considered to be discontinuous, e.g., where the lower one of the parameter values before and after the step change is less than 80%, or less than 50%, or less than 20%, or less than 10%, or less than 5%, or less than 2% or less than 1%, of the higher one of the parameter values before and after the step change over a period of time of 1 minute, 10 seconds, 1 second, or 1 millisecond.

In embodiments, the conductive channels are formed in situ after placement of the proppant particles in the fracture by differential movement of the proppant particles, e.g., by gravitational settling and/or fluid movement such as fluid flow initiated by a flowback operation, out of and/or away from an area(s) corresponding to the conductive channel(s) and into or toward spaced-apart areas in which clustering of the proppant particles results in the formation of relatively less conductive areas, which clusters may correspond to pillars between opposing fracture faces upon closure.

Embodiments of the disclosed subject matter enable increasing conductivity of a solid particulate or proppant pack in a void by forming highly conductive channels by means of proppant settling in the presence of an anchorant. Formation of such channels is accomplished by redistributing proppant in a fracturing fluid during anchoring-assisted non-homogeneous settling. Such non-homogeneous settling causes the formation of "islands" or "clusters" or "pillars" of proppant-rich clusters surrounded by substantially proppant-free fluid. Void closure results in creation of channels between the proppant clusters. When such channels interconnect, the void has significantly higher conductivity than the conductivity of a void treated with a treatment slurry which exhibits homogeneous proppant settling.

As used herein, the term void means any open space in a geological formation, including naturally occurring open spaces and open spaces formed between the geological formation and one or more objects placed into the geological formation. A void may be a fracture. In certain embodiments, the void may be a fracture with a narrowest dimension of the fracture being from 1 micron to 20 mm. All values and subranges from 1 micron to 20 mm are included and disclosed herein; for example, the narrowest dimension of the fracture may be from a lower limit of 1 micron, 300 microns, 600 microns, 900 microns, 10 mm or 15 mm to an upper limit of 15 microns, 500 microns, 800 microns, 2 mm, 12 mm, or 20 mm. For example, the narrowest dimension of the fracture may be from 1 micron to 20 mm, or from 1 micron to 1 mm, from 1 mm to 20 mm, or from 1 mm to 10 mm, or from 10 mm to 20 mm.

In embodiments, the conductive channels are formed in situ after placement of the proppant particles in the fracture by differential movement of the proppant particles, e.g., by gravitational settling and/or fluid movement such as fluid flow initiated by a flowback operation, out of and/or away from an area(s) corresponding to the conductive channel(s) and into or toward spaced-apart areas in which clustering of the proppant particles results in the formation of relatively less conductive areas, which clusters may correspond to pillars between opposing fracture faces upon closure.

In some embodiments, an in situ channelization treatment slurry stage has a concentration of solid particulates, e.g., proppant, and a concentration of an additive that facilitates either clustering of the particulates in the fracture, or anchoring of the clusters in the fracture, or a combination thereof, to form anchored clusters of the solid particulates to prop open the fracture upon closure. The term solid particulate includes particles which may function as one or more of, for example, proppants and/or anchorants. For example, a particle may function alone or in combination with other particles as an anchorant during all or part of the cluster formation and/or anchoring stage(s), and may also function alone or in combination with other particles as a proppant in all or part of the fracture closure stage(s) and/or temporarily or permanently in the production stage(s).

In embodiments, the solid particulates, including any proppants and any anchorants, may have any size or size distribution in the range from 10 nm to 5 mm. All values and subranges from 10 nm to 5 mm are included and disclosed herein. For example, the solid particulates may have a size from 10 nm to 5 mm, or from 0.1 mm to 2 mm, or from 0.1 mm to 5 mm, or from 10 nm to 0.001 mm, or from 0.001 mm to 5 mm, or from 0.0005 mm to 5 mm, or from 1000 nm to 1 mm. In further embodiments, the solid particulates have an average particle size from 1 micron to 5000 microns. All values and subranges from 1 to 5000 microns are included and disclosed herein; for example, the solid particulate has an average particle size from a lower limit of 1, 300, 900, 2000, 2400, 3300 or 4800 microns to an upper limit of 200, 700, 1500, 2200, 2700, 3500 or 5000 microns. For example, the solid particulates have an average particle size from 1 to 5000 microns, or from 1 to 2500 microns, or from 2500 to 5000 microns, or from 1 micron to 1 mm, or from 10 microns to 800 microns. As used herein, the term average particle size refers to the average size of the largest dimension of the solid particulate.

In further embodiments, the solid particulates are present in the slurry in an amount of less than 35 vol %, or in an amount of less than 22 vol %. All values and subranges of less than 35 vol % are included and disclosed herein. For example the solid particulate may be present in an amount of 35 vol %, or less than 22 vol %, or less than 18 vol %, or less than 15 vol %, or less than 12 vol %.

The solid particulates may have any shape provided they meet any requirements for aspect ratio, defined as the ratio of the longest dimension of the particle to the shortest dimension of the particle, including fibers, tubes, regular beads, irregular beads, flakes, ribbons, platelets, rods, tubes or any combination of two or more thereof.

In further embodiments, the solid particulates comprise a mixture or blend of two or more particulate solids, e.g., proppant as at least a first particulate solid and anchorant as at least a second particulate. For example, the solid particulates may comprise a first solid particulate type having a first average particle size, a second solid particulate type having a second average particle size, a third solid particulate type having a third average particle size, and so on. Alternatively, the two or more solid particulate types may have different densities, shapes, aspect ratios, structures, compositions and/or chemical properties.

As used herein unless otherwise specified, as described in further detail herein, particle size and particle size distribution (PSD) mode refer to the median volume averaged size. The median size used herein may be any value understood in the art, including for example and without limitation a diameter of roughly spherical particulates. In an embodiment, the median size may be a characteristic dimension, which may be a dimension considered most descriptive of the particles for specifying a size distribution range.

In embodiments, the particles may be multimodal, e.g., the proppant and anchorant may each be unimodal having different particle sizes, or the proppant, the anchorant or both may be multimodal. As used herein multimodal refers to a plurality of particle sizes or modes which each has a distinct size or particle size distribution, e.g., proppant and fines. As used herein, the terms distinct particle sizes, distinct particle size distribution, or multi-modes or multimodal, mean that each of the plurality of particles has a unique volume-averaged PSD) mode. That is, statistically, the particle size distributions of different particles appear as distinct peaks (or "modes") in a continuous probability distribution function. For example, a mixture of two particles having normal distribution of particle sizes with similar variability is considered a bimodal particle mixture if their respective means differ by more than the sum of their respective standard deviations, and/or if their respective means differ by a statistically significant amount. In an embodiment, the particles contain a bimodal mixture of two particles; in an embodiment, the particles contain a trimodal mixture of three particles; in an embodiment, the particles contain a tetramodal mixture of four particles; in an embodiment, the particles contain a pentamodal mixture of five particles, and so on. Representative references disclosing multimodal particle mixtures include U.S. Pat. Nos. 5,518,996, 7,784,541, 7,789,146, 8,008,234, 8,119,574, 8,210,249, US 2010/0300688, US 2012/0000641, US 2012/0138296, US 2012/0132421, US 2012/0111563, WO 2012/054456, US 2012/0305245, US 2012/0305254, US 2012/0132421, PCT/RU2011/000971 and U.S. Ser. No. 13/415,025, each of which are hereby incorporated herein by reference.

In an embodiment, the particle(s) is substantially round and spherical. In an embodiment, the particle(s) is not substantially spherical and/or round, e.g., it can have varying degrees of sphericity and roundness, according to the API RP-60 sphericity and roundness index. For example, the particle(s) used as proppant may be substantially round and spherical and have a low aspect ratio, e.g., 1-2, while the particle(s) used as anchorants or otherwise may have an aspect ratio of more than 2, more than 3, more than 4, more than 5 or more than 6. All values and subranges from greater than 6 or disclosed and included herein. For example, the anchorant may have an aspect ratio of greater than 6, or greater than or equal to 20, or greater than or equal to 40, or greater than or equal to 50. In further embodiments, the anchorant is selected from the group of solid particles having an aspect ratio greater than 6. Examples of such non-spherical particles include, but are not limited to, fibers, flocs, flakes, discs, rods, stars, etc. All such variations should be considered within the scope of the current application.

Introducing high-aspect ratio particles into the treatment fluid, e.g., particles having an aspect ratio of at least 6, represents additional or alternative embodiments for stabilizing the treatment fluid and inhibiting settling during proppant placement, which can be removed, for example by dissolution or degradation into soluble degradation products. Examples of such non-spherical particles include, but are not limited to, fibers, flocs, flakes, discs, rods, stars, etc., as described in, for example, U.S. Pat. No. 7,275,596, US20080196896, which are hereby incorporated herein by reference. In an embodiment, introducing ciliated or coated proppant into the treatment fluid may also stabilize or help stabilize the treatment fluid or regions thereof. Proppant or other particles coated with a hydrophilic polymer can make the particles behave like larger particles and/or more tacky particles in an aqueous medium. The hydrophilic coating on a molecular scale may resemble ciliates, i.e., proppant particles to which hairlike projections have been attached to or formed on the surfaces thereof. Herein, hydrophilically coated proppant particles are referred to as "ciliated or coated proppant." Hydrophilically coated proppants and methods of producing them are described, for example, in WO 2011-050046, U.S. Pat. Nos. 5,905,468, 8,227,026 and 8,234,072, which are hereby incorporated herein by reference.

"Solids" and "solids volume" refer to all solids present in the slurry, including anchorant, proppant and subproppant particles, including any particulate thickeners such as colloids and submicron particles. "Solids-free" and similar terms generally exclude anchorant, proppant and subproppant particles, except particulate thickeners such as colloids for the purposes of determining the viscosity of a "solids-free" fluid.

As used herein, lean with respect to a component means having less than 40% such component. All individual values and subranges of less than 40% are included and disclosed herein. For example, substantially free of such component may be less than 40% such component, or less than 20% such component, or less than 10% such component. Substantially free of a component means less than 5% of such component, or less than 2.5% such component, or less than 1.25% such component, or less than 0.625% such component, or less than 0.5% of such component, or less than 0.25% of such component, or less than 0.1% of such component, or less than 0.05% of such component, or less than 0.025% of such component, or less than 0.01% of such component, or less than 0.005% of such component, or less than 0.0025% of such component, or less than 0.001% of such component.

As used herein, rich in a component means having greater than 40% such component. All individual values and subranges of greater than 40% are included and disclosed herein. For example, rich in such component may be greater than 40% such component, or greater than 60% such component, or greater than 90% such component, or greater than 95% such component, or greater than 97% such component, or greater than 98% such component.

"Proppant" refers to particulates that are used in well work-overs and treatments, such as hydraulic fracturing operations, to hold fractures open following the treatment. In some embodiments, the proppant may be of a particle size mode or modes in the slurry having a weight average mean particle size greater than or equal to about 100 microns, e.g., 140 mesh particles correspond to a size of 105 microns. In further embodiments, the proppant may comprise particles or aggregates made from particles with size from 0.001 to 1 mm. All individual values from 0.001 to 1 mm are disclosed and included herein. For example, the solid particulate size may be from a lower limit of 0.001, 0.01, 0.1 or 0.9 mm to an upper limit of 0.009, 0.07, 0.5 or 1 mm. Here particle size is defined is the largest dimension of the grain of said particle.

"Gravel" refers to particles used in gravel packing, and the term is synonymous with proppant as used herein. "Sub-proppant" or "subproppant" refers to particles or particle size or mode (including colloidal and submicron particles) having a smaller size than the proppant mode(s); references to "proppant" exclude subproppant particles and vice versa. In an embodiment, the sub-proppant mode or modes each have a weight average mean particle size less than or equal to about one-half of the weight average mean particle size of a smallest one of the proppant modes, e.g., a suspensive/stabilizing mode.

The proppant, when present, can be naturally occurring materials, such as sand grains. The proppant, when present, can also be man-made or specially engineered, such as coated (including resin-coated) sand, modulus of various nuts, high-strength ceramic materials like sintered bauxite, etc. In further embodiments, the solid particulates have density from 0.1 g/mL to 10 g/mL. All values and subranges from 0.1 g/mL to 10 g/mL are included herein and disclosed herein. For example, the solid particulate density may be from a lower value of 0.1, 1, 3, 5, 7, or 9 g/mL to an upper value of 2, 4, 6, 8, or 10 g/mL. For example, the solid particulate density may be from 1 g/mL to 5 g/mL, or from 2 g/mL to 4 g/mL. In further embodiments, the density of the solid particulate is more than the density of the carrier fluid or the energized carrier fluid.

In further embodiments, the proppant of the current application, when present, has a density greater than 2.45 g/mL, e.g., 2.5-2.8 g/mL, such as sand, ceramic, sintered bauxite or resin coated proppant. In some embodiments, the proppant of the current application, when present, has a density greater than or equal to 2.8 g/mL, and/or the treatment fluid may comprise an apparent specific gravity less than 1.5, less than 1.4, less than 1.3, less than 1.2, less than 1.1, or less than 1.05, less than 1, or less than 0.95, for example. In some embodiments a relatively large density difference between the proppant and carrier fluid may enhance proppant settling during the clustering phase, for example.

In some embodiments, the proppant of the current application, when present, has a density less than or equal to 2.45 g/mL, such as light/ultralight proppant from various manufacturers, e.g., hollow proppant. In some embodiments, the treatment fluid comprises an apparent specific gravity greater than 1.3, greater than 1.4, greater than 1.5, greater than 1.6, greater than 1.7, greater than 1.8, greater than 1.9, greater than 2, greater than 2.1, greater than 2.2, greater than 2.3, greater than 2.4, greater than 2.5, greater than 2.6, greater than 2.7, greater than 2.8, greater than 2.9, or greater than 3. In some embodiments where the proppant may be buoyant, i.e., having a specific gravity less than that of the carrier fluid, the term "settling" shall also be inclusive of upward settling or floating.

In some embodiments, any proppant material meeting the aspect ratio of less than or equal to 6 and useful in well treatment fluids may be used. Exemplary proppants include ceramic proppant, sand, bauxite, glass beads, crushed nuts shells, polymeric proppant, and mixtures thereof.

As used herein, "anchorant" refers to a material, a precursor material, or a mechanism, that inhibits settling, or preferably stops settling, of particulates or clusters of particulates in a fracture, whereas an "anchor" refers to an anchorant that is active or activated to inhibit or stop the settling. In some embodiments, the anchorant may comprise a material, such as fibers, flocs, flakes, discs, rods, stars, etc., for example, which may be heterogeneously distributed in the fracture and have a different settling rate, and/or cause some of the first solid particulate to have a different settling rate, which may be faster or preferably slower with respect to the first solid particulate and/or clusters. As used herein, the term "flocs" includes both flocculated colloids and colloids capable of forming flocs in the treatment slurry stage.

In some embodiments, the anchorant may adhere to one or both opposing surfaces of the fracture to stop movement of a proppant particle cluster and/or to provide immobilized structures upon which proppant or proppant cluster(s) may accumulate. In some embodiments, the anchors may adhere to each other to facilitate consolidation, stability and/or strength of the formed clusters.

In some embodiments, the anchorant may comprise a continuous concentration of a first anchorant component and a discontinuous concentration of a second anchorant component, e.g., where the first and second anchorant components may react to form the anchorant as in a two-reactant system, a catalyst/reactant system, a pH-sensitive reactant/pH modifier system, or the like.

In some embodiments, the anchorant may form lower boundaries for particulate settling.

In some embodiments, the anchorant may have different characteristics relative to proppant or other solid particulates to impart different settling rates. In some embodiments, the anchorant and the other solid particulates, for example proppant, may have different shapes, sizes, densities or a combination thereof. In some embodiments, the anchorant is a shape that inhibits settling, such as a fiber, a floc, a flake, a ribbon, a platelet, a rod, or a combination thereof, and in further embodiments, the proppant is a shape that facilitates settling, e.g., a bead, an irregular bead, a grain of sand, etc. or a combination of these.

In some embodiments, the anchorant has an aspect ratio higher than an aspect ratio of the proppant, e.g., where the anchorant has an aspect ratio greater than 6 the proppant may have an aspect ratio less than 6, e.g., less than 5, less than 4, less than 3, less than 2, less than 1.5, less than 1.2, less than 1.1, less than 1.05, etc. In further embodiments, the anchorant may have an aspect ratio less than or equal to 6. All values and subranges from less than or equal to 6 are included herein and disclosed herein. For example, the solid particulate aspect ratio may be less than or equal to 6, or less than or equal to 5.5, or less than or equal to 5.

In further embodiments, the anchorant is a particulate having a density between 0.1 g/mL to 10 g/mL. All values and subranges from 0.1 g/mL to 10 g/mL are included herein and disclosed herein. For example, the anchorant density may be from a lower value of 0.1, 1, 3, 5, 7, or 9 g/mL to an upper value of 2, 4, 6, 8, or 10 g/mL. For example, the anchorant density may be from 1 g/mL to 5 g/mL, or from 2 g/mL to 4 g/mL.

In further embodiments, the density of the anchorant is less than the density of the carrier fluid, or in embodiments where the carrier fluid is energized, less than the density of the energized carrier fluid.

In further embodiments, the largest dimension of the anchorant particles is comparable to the narrowest dimension of the void, or fracture. As used herein, comparable means not differing by more than 20 fold. For example, the solid particulates and/or anchorant may have a size from 0.05 to 20 fold of the narrowest dimension of the void (e.g. fracture width), or from 0.1 to 10 fold of the narrowest dimension of the void (e.g. fracture width), or from 0.33 to 3 fold of the narrowest dimension of the void (e.g. fracture width). The largest dimension of the anchorant may also be comparable to the narrowest dimension of the void, or fracture. For example, if the fracture narrowest dimension, i.e. width, is 2 mm, the average largest dimension of the anchorant may be between 0.1 and 40 mm. In various embodiments, expected void widths range from 1 micron to 20 mm. All individual values and subranges from 1 micron to 20 mm are disclosed and included herein.

In further embodiments, the largest dimension of the anchorant is from 0.5 micron to 50 mm. All values and subranges from 0.5 microns to 50 mm; for example, the anchorant largest dimension may be from a lower limit of 0.5 microns, 100 microns, 500 microns, 900 microns, 20 mm or 40 mm to an upper limit of 10 microns, 250 microns, 750 microns, 10 mm, 30 mm or 50 mm. For example, the anchorant largest dimension may be from 0.5 micron to 50 mm, or from 1 mm to 20 mm, or from 0.5 microns to 20 mm, or from 20 to 50 mm, or from 0.5 microns to 30 mm.

In further embodiments, some or all of the solid particulates and/or anchorant are made of degradable, meltable, soluble or dissolvable materials. In another embodiment, the treatment slurry further comprises one or more agent(s) that accelerate or control degradation of degradable solid particulates. For example, NaOH, $CaCO_3$ and $Ca(OH)_2$ may be added to the treatment slurry to control degradation of particulate materials comprising polylactic acid. Likewise, an acid may be used to accelerate degradation for particulate materials comprising polysaccharides and polyamides.

In some embodiments, the anchorant may comprise a degradable material. In some embodiments, the anchorant is selected from the group consisting of polylactic acid (PLA), polyglycolic acid (PGA), polyethylene terephthalate (PET), polyester, polyamide, polycaprolactam and polylactone, poly(butylene) succinate, polydioxanone, glass, ceramics, carbon (including carbon-based compounds), elements in metallic form, metal alloys, wool, basalt, acrylic, polyethylene, polypropylene, novoloid resin, polyphenylene sulfide, polyvinyl chloride, polyvinylidene chloride, polyurethane, polyvinyl alcohol, polybenzimidazole, polyhydroquinone-diimidazopyridine, poly(p-phenylene-2,6-benzobisoxazole), rayon, cotton, cellulose, or other natural fibers, rubber, sticky fiber, or a combination thereof. In some embodiments the anchorant may comprise acrylic fiber. In some embodiments the anchorant may comprise mica.

In some embodiments, the anchorant may comprise an expandable material, such as, for example, swellable elastomers, temperature expandable particles, and so on. Examples of oil swellable elastomers include butadiene based polymers and copolymers such as styrene butadiene rubber (SBR), styrene butadiene block copolymers, styrene isoprene copolymer, acrylate elastomers, neoprene elastomers, nitrile elastomers, vinyl acetate copolymers and blends of ethylene-vinyl acetate copolymers (EVA), and polyurethane elastomers. Examples of water and brine swellable elastomers include maleic acid grafted styrene butadiene elastomers and acrylic acid grafted elastomers. Examples of temperature expandable particles include metals and gas filled particles that expand more when the particles are heated relative to silica sand. In some embodiments, the expandable metals can include a metal oxide of Ca, Mn, Ni, Fe, etc. that reacts with the water to generate a metal hydroxide which has a lower density than the metal oxide, i.e., the metal hydroxide occupies more volume than the metal oxide thereby increasing the volume occupied by the particle. Further examples of swellable inorganic materials can be found in U.S. Application Publication Number US 20110098202, which is hereby incorporated by reference in its entirety. An example for gas filled material is EXPANCEL™ microspheres that are manufactured by and commercially available from Akzo Nobel of Chicago, Ill. These microspheres contain a polymer shell with gas entrapped inside. When these microspheres are heated the gas inside the shell expands and increases the size of the particle. The diameter of the particle can increase 4 times which could result in a volume increase by a factor of 64.

In some embodiments, the anchorant is present in the anchorant-laden stages of the treatment slurry in an amount of less than 5 vol %. All individual values and subranges from less than 5 vol % are included and disclosed herein. For example, the amount of anchorant may be from 0.05 vol % less than 5 vol %, or less than 1 vol %, or less than 0.5 vol %. The anchorant may be present in an amount from 0.5 vol % to 1.5 vol %, or in an amount from 0.01 vol % to 0.5 vol %, or in an amount from 0.05 vol % to 0.5 vol %.

In some embodiments, a method for treating a subterranean formation penetrated by a wellbore comprises: injecting a treatment stage fluid above a fracturing pressure to form a fracture in the formation; distributing particulates into the formation in the treatment stage fluid; aggregating the solid particulates distributed into the fracture to form spaced-apart clusters in the fracture; anchoring at least some of the clusters in the fracture to inhibit aggregation of at least some of the clusters; reducing pressure in the fracture to prop the fracture open on the clusters and form interconnected, hydraulically conductive channels between the clusters.

In some embodiments, the solid particulates distributed in the treatment stage fluid comprise disaggregated proppant. In some embodiments, the aggregation comprises triggering settling of the distributed solid particulates. In some embodiments, the method further comprises viscosifying the treatment stage fluid for distributing the solid particulates into the formation, and breaking the treatment stage fluid in the fracture to trigger the settling. In some embodiments, the method further comprises successively alternating concentration modes of an anchorant in the treatment stage fluid between a relatively anchorant-rich mode and an anchorant-lean mode during the continuous distribution of the solid particulate into the formation in the treatment stage fluid to facilitate one or both of the cluster aggregation and anchoring. As used herein, an anchorant is an additive either which induces or facilitates agglomeration of solid particulates into clusters, or which facilitates the activation of anchors, as defined above, or both. In some embodiments, the anchorant comprises fibers, flocs, flakes, discs, rods, stars, etc. In some embodiments, the anchorant-lean concentration mode is free or essentially free of anchorant, or a difference between the concentrations of the anchorant-rich and anchorant-lean modes is at least 10, or at least 25, or at least 40, or at least 50, or at least 60, or at least 75, or at least 80, or at least 90, or at least 95, or at least 98, or at least 99, or at least 99.5 weight percent of the anchorant concentration of the anchorant-rich mode. An anchorant-lean mode is essentially free of anchorant if the concentration of anchorant is insufficient to form anchors.

In further embodiments, the anchorant may comprise a fiber with a length from 1 to 50 mm, or more specifically from 1 to 10 mm, and a diameter of from 1 to 75 microns, or, more specifically from 1 to 50 microns. All values and subranges from 1 to 50 mm are included and disclosed herein. For example, the fiber anchorant length may be from a lower limit of 1, 3, 5, 7, 9, 19, 29 or 49 mm to any higher upper limit of 2, 4, 6, 8, 10, 20, 30 or 50 mm. The fiber anchorant length may range from 1 to 50 mm, or from 1 to 10 mm, or from 1 to 7 mm, or from 3 to 10 mm, or from 2 to 8 mm. All values from 1 to 50 microns are included and disclosed herein. For example, the fiber anchorant diameter may be from a lower limit of 1, 4, 8, 12, 16, 20, 30, 40, or 49 microns to an upper limit of 2, 6, 10, 14, 17, 22, 32, 42, 50 or 75 microns. The fiber anchorant diameter may range from 1 to 75 microns, or from 10 to 50 microns, or from 1 to 15 microns, or from 2 to 17 microns. In further embodiments, the anchorant is a fiber with a length from 0.001 to 1 mm and a diameter of from 10 nanometers (nm) to 5 millimeters. All individual values from 0.001 to 1 mm are disclosed and included herein. For example, the anchorant fiber length may be from a lower limit of 0.001, 0.01, 0.1 or 0.9 mm to an upper limit of 0.009, 0.07, 0.5 or 1 mm. All individual values from 10 nanometers (nm) to 5 millimeters are included and disclosed herein. For example, the fiber anchorant diameter may range from a lower limit of 50, 60, 70, 80, 90, 100, or 500 nanometers to an upper limit of 500 nanometers, 1 micron, or 10 microns.

In further embodiments, the anchorant is a fiber with a length of from 0.5 to 5 times the width (i.e. smallest dimension) of a subterranean void to be treated with the treatment slurry. In various embodiments, expected void widths range from 1 micron to 20 mm. All individual values and subranges from 1 micron to 20 mm are disclosed and included herein.

In further embodiments, the anchorant may be fiber selected from the group consisting of polylactic acid (PLA), polyester, polycaprolactam, polyamide, polyglycolic acid, polyterephthalate, cellulose, wool, basalt, glass, rubber, or a combination thereof.

In some embodiments, the conductive channels extend in fluid communication from adjacent a face of in the formation away from the wellbore to or to near the wellbore, e.g., to facilitate the passage of fluid between the wellbore and the formation, such as in the production of reservoir fluids and/or the injection of fluids into the formation matrix. As used herein, "near the wellbore" refers to conductive channels coextensive along a majority of a length of the fracture terminating at a permeable matrix between the conductive channels and the wellbore, e.g., where the region of the fracture adjacent the wellbore is filled with a permeable solids pack as in a high conductive proppant tail-in stage, gravel packing or the like.

In some embodiments, the injection of the treatment fluid stage forms a homogenous region within the fracture of continuously uniform distribution of the first solid particulate. In some embodiments, the alternation of the concentration of the anchorant forms heterogeneous areas within the fracture comprising anchorant-rich areas and anchorant-lean areas.

In some embodiments, the injected treatment fluid stage comprises a viscosified carrier fluid, and the method may further comprise reducing the viscosity of the carrier fluid in the fracture to induce settling of the first solid particulate prior to closure of the fracture, and thereafter allowing the fracture to close.

In some embodiments, the method may also include forming bridges with the anchorant-rich modes in the fracture and forming conductive channels between the bridges with the anchorant-lean modes.

In some embodiments, a method for treating a subterranean formation penetrated by a wellbore comprises: injecting into a fracture in the formation at a treatment fluid stage comprising a viscosified carrier fluid with solid particulates and anchors to form a homogenous region within the fracture of uniform distribution; reducing the viscosity of the carrier fluid within the homogenous region to induce settling of the first solid particulate prior to closure of the fracture to form hydraulically conductive channels and pillars; and thereafter allowing the fracture to close onto the pillars.

In some embodiments, methods for treating a subterranean formation penetrated by a wellbore are disclosed; such methods comprising providing a treatment slurry comprising a carrier fluid or an energized carrier fluid, a solid particulate and an anchorant; injecting the treatment slurry into a fracture to form a substantially uniformly distributed mixture of the solid particulate and injecting the anchorant; and transforming the substantially uniform mixture into areas that are rich in solid particulate and areas that are substantially free of solid particulate, wherein the solid particulate and the anchorant have substantially dissimilar settling, i.e. flow or velocities in the fracture and wherein said transforming results from said substantially dissimilar velocities. Such dissimilar velocities may, in some embodiments, arise, partially or wholly, from the interaction of the anchorant with the fracture wall, such interaction including for example, those arising by friction. As used herein, substantially dissimilar means differing by at least 20%. All values and subranges from at least 20% are included herein and disclosed herein. For example, the sedimentation rates of anchorant and other particulate may differ by at least 20%, or differ by at least 50%, differ by at least 75%, or differ by at least 100%, or differ by at least 150%.

In further embodiments, compositions are disclosed, said compositions comprising: a carrier fluid or an energized carrier fluid; a plurality of solid particulates; and an anchorant; wherein the composition is capable of transforming via settling from a first state of being substantially homogeneously mixed and a second state comprising portions that are rich in the solid particulates and portions that are substantially free of the solid particulates. Such transformation may, in some embodiments, arise, partially or wholly, from differing settling rates of anchorant and other solid particulates. Such differing settling rates may, in some embodiments, arise partially or wholly from the interaction of the anchorant with the fracture wall, such interaction including for example, those arising by friction.

Further embodiments disclose methods comprising: providing a slurry comprising a carrier fluid or an energized carrier fluid, a solid particulate and an anchorant; flowing the slurry into a void to form a substantially uniformly distributed mixture of the solid particulate and the anchorant; and transforming the substantially uniformly distributed mixture into areas that are rich in solid particulate and areas that are substantially free of solid particulate, wherein the anchorant and other solid particulate have substantially dissimilar settling, or flow, velocities in the void and wherein said transforming results from said substantially dissimilar velocities. Such dissimilar velocities may, in some embodiments, arise, partially or wholly, from the interaction of the anchorant with the fracture wall, such interaction including for example, those arising by friction.

Further embodiments disclose methods of designing a treatment, comprising: considering a fracture dimension; selecting an anchorant having a dimension comparable to the fracture width dimension; selecting a solid particulate having a substantially different settling velocity from the anchorant; formulating a treatment fluid comprising the solid particulate and the anchorant such that the treatment fluid is capable of transforming via settling from a first state of being substantially homogeneously mixed and a second state comprising portions that are rich of the solid particulates and portions that are substantially free of the solid particulates; and pumping the treatment fluid into a well to create and/or enlarge the fracture.

All embodiments disclosed may contain a carrier fluid or an energized carrier fluid with at least one additive selected from the group consisting of viscosifiers, gelling agents and rheological agents. In some embodiments, the carrier fluid is energized with carbon dioxide. In some embodiments, the carrier fluid is energized with air. In some embodiments, the carrier fluid is energized with nitrogen. Said carrier fluid may also be energized with helium, argon, or hydrocarbon gases (such as methane, ethane, propane, butane, pentane, hexane, heptane . . . ), and mixtures thereof.

In some embodiments, the energized carrier fluid comprises a foam quality effective to facilitate fluid loss control in the fracture.

In some embodiments, the energized carrier fluid comprises a foam quality effective to increase viscosity of the stabilized slurry and facilitate formation of a relatively wider fracture.

In some embodiments, the method may further comprise expanding gas in the carrier fluid to drive flowback through the proppant pack to the wellbore.

In some embodiments, the energized carrier fluid comprises a foam quality effective to promote slot flow of the solids in the fracture.

In some embodiments, the energized carrier fluid comprises surfactant to change wettability of a surface of the formation.

In some embodiments, a system to produce reservoir fluids comprises the wellbore and the fracture resulting from any of the fracturing methods disclosed herein.

In some embodiments, the system may also include a treatment fluid supply unit, e.g., a pumping and/or mixing system(s), to supply additional anchorant-rich and anchorant-lean substages of the treatment fluid stage to the wellbore.

In some embodiments, a system to treat a subterranean formation penetrated by a wellbore comprises: a pump system which may comprise one or more pumps to deliver a treatment stage fluid through the wellbore to the formation above a fracturing pressure to form a fracture in the formation; a treatment stage fluid supply unit to continuously distribute solid particulates into the treatment stage fluid, and to introduce an anchorant into the treatment stage fluid; a trigger in the treatment stage fluid to initiate aggregation of the solid particulates in the fracture to form spaced-apart clusters in the fracture; an anchoring system in the treatment fluid stage to anchor the clusters in the fracture and inhibit aggregation of the clusters; and a shut-in system to maintain and then reduce pressure in the fracture to prop the fracture open on the clusters and form interconnected, hydraulically conductive channels between the clusters.

In some embodiments, the initiation of the aggregation of the first solid particulate may comprise gravitational settling of the first solid particulate. In embodiments, the treatment fluid stage may comprise a viscosified carrier fluid, and the trigger may be a breaker.

Following the injection of the fracturing fluid, the well in some embodiments may be shut in or the pressure otherwise sufficiently maintained to keep the fracture from closing. In some embodiments, the gravitational settling of proppant as illustrated may be initiated, e.g., by activation of a trigger to destabilize the fracturing fluid, such as, for example, a breaker and optionally a breaker aid to reduce the viscosity of the fracturing fluid. Anchorants may optionally also settle in the fracture, e.g., at a slower rate than the proppant, which may result in some embodiments from the anchorants having a specific gravity that is equal to or closer to that of the carrier fluid than that of the proppant. As one non-limiting example, the proppant may be sand with a specific gravity of 2.65, the anchorants may be a localized fiber-laden region comprising fiber with a specific gravity of 1.1-1.5, e.g., polylactic acid fibers having a specific gravity of 1.25, and the carrier fluid may be aqueous with a specific gravity of 1-1.1. In this example, the anchorants may have a lower settling rate relative to the proppant. In other embodiments, the anchorants may interact with either or both of the fracture faces, e.g. by friction or adhesion, and may have a density similar or dissimilar to that of the proppant, e.g., glass fibers may have a specific gravity greater than 2.

As a result of differential settling rates according to some embodiments, the proppant forms clusters adjacent respective anchorants, and settling is retarded. Finally, in some embodiments, the anchorants are activated to immobilized anchoring structures to hold the clusters fast against the opposing surface(s) of the fracture. The clusters prop the fracture open to form hydraulically conductive channels between the clusters for the flow of reservoir fluids toward the wellbore during a production phase.

For example, the weight of proppant added per unit volume of carrier fluid may be initially 0.048 g/mL (0.4 lbs proppant added per gallon of carrier fluid (ppa)) and ramped up to 0.48 g/mL (4 ppa) or 0.72 g/mL (6 ppa) or 1.4 g/mL (12 ppa). In embodiments, the proppant-containing treatment fluid may comprise from 0.06 or 0.12 g of proppant per mL of treatment fluid (corresponding to 0.5 or 1 ppa) up to 1.2 or 1.8 g/mL (corresponding to 10 or 15 ppa). In some embodiments, the proppant-laden treatment fluid may have a relatively low proppant loading in earlier-injected fracturing fluid and a relatively higher proppant loading in later-injected fracturing fluid, which may correspond to a relatively narrower fracture width adjacent a tip of the fracture and a relatively wider fracture width adjacent the wellbore. For example, the proppant loading may initially begin at 0.48 g/mL (4 ppa) and be ramped up to 0.6 g/mL (6 ppa) at the end. Concurrently, the fiber-free and fiber-laden substages are alternated, e.g., with the fiber free substages comprising no added fiber or <0.12 g/L and the fiber laden stages comprising 0.12-12 g/L (1-100 lbs/thousand gallons (ppt)) added fiber.

In embodiments, the wellbore may include a substantially horizontal portion, which may be cased or completed open hole, wherein the fracture is transversely or longitudinally oriented and thus generally vertical or sloped with respect to horizontal. A mixing station in some embodiments may be provided at the surface to supply a mixture of carrier fluid from source, any proppant from source, which may for example be an optionally stabilized concentrated blend slurry (CBS) to allow a continuous proppant concentration, any fiber from source, which may for example be a concentrated masterbatch, and any other additives which may be supplied with any of the sources or an additional optional source(s), in any order, such as, for example, viscosifiers, loss control agents, friction reducers, clay stabilizers, biocides, crosslinkers, breakers, breaker aids, corrosion inhibitors, and/or proppant flowback control additives, or the like. In some embodiments, concentrations of one or more additives, including other or additional anchorants and/or anchorant precursors, to the fracturing fluid may be alternated, e.g., in addition to alternating fiber concentration.

The well may if desired also be provided with a shut in valve to maintain pressure in the wellbore and fracture, flow-back/production line to flow back or produce fluids either during or post-treatment, as well as any conventional wellhead equipment.

Maintaining a relatively smooth proppant concentration during pumping in some embodiments enables the stability of the pulses of anchorant or other pulsed materials even in a multistage environment because of the relatively insignificant change of the carrier fluid.

The concept according to some embodiments herein can thus minimize interface mixing which may appear during pulsing operations and thus enable better stability, which may in turn provide deeper transportation of the pulses of anchorant or other pulsed materials inside the fracture away from the wellbore, which in turn, can provide better channelization. In some embodiments the pulses may maintain their distinct character more deeply into the fracture with minimal blurring of the pulses at the margins with other treatment fluid preceding, following or between the pulsed materials.

In some embodiments, the ability of the fracturing fluid to suspend the proppant is reduced after finishing the fracturing treatment and before fracture closure to a level which triggers gravitational settling of the propping agent inside the fracture. For example, the fracturing fluid may be stabilized during placement with a viscosified carrier fluid and destabilized by breaking the viscosity after placement in the fracture and before closure. Proppant settling results in the creation of heterogeneity of proppant distribution inside the fracture because the rate of proppant settling in presence of fiber is significantly slower than without fiber. At some certain concentrations of fiber and propping agent according to embodiments herein, it is possible to enable the creation of stable interconnected proppant free areas and proppant rich clusters which in turn enables high conductivity of the fracture after its closure.

As used herein, the terms "treatment fluid" or "wellbore treatment fluid" are inclusive of "fracturing fluid" or "treatment slurry" and should be understood broadly. These may be or include a liquid, a solid, a gas, and combinations thereof, as will be appreciated by those skilled in the art. A treatment fluid may take the form of a solution, an emulsion, an energized fluid (including foam), slurry, or any other form as will be appreciated by those skilled in the art. In some embodiments, the treatment fluid is an energized fluid that contains a viscosifier which upon breakage enables the clustering of the solid particulates into high strength pillars being stabilized and/or reinforced by anchors.

"Treatment fluid" or "fluid" (in context) refers to the entire treatment fluid, including any proppant, subproppant particles, liquid, gas etc. "Whole fluid," "total fluid" and "base fluid" are used herein to refer to the fluid phase plus any subproppant particles dispersed therein, but exclusive of proppant particles. "Carrier," "fluid phase" or "liquid phase" refer to the fluid or liquid that is present, which may comprise a continuous phase and optionally one or more discontinuous gas or liquid fluid phases dispersed in the continuous phase, including any solutes, thickeners or colloidal particles only, exclusive of other solid phase particles; reference to "water" in the slurry refers only to water and excludes any gas, liquid or solid particles, solutes, thickeners, colloidal particles, etc.; reference to "aqueous phase" refers to a carrier phase comprised predominantly of water, which may be a continuous or dispersed phase. As used herein the terms "liquid" or "liquid phase" encompasses both liquids per se and supercritical fluids, including any solutes dissolved therein.

The term "dispersion" means a mixture of one substance dispersed in another substance, and may include colloidal or non-colloidal systems. As used herein, "emulsion" generally means any system with one liquid phase dispersed in another immiscible liquid phase, and may apply to oil-in-water and water-in-oil emulsions. Invert emulsions refer to any water-in-oil emulsion in which oil is the continuous or external phase and water is the dispersed or internal phase.

As used herein, "slurry" refers to an optionally flowable mixture of particles dispersed in a fluid carrier. The terms "flowable" or "pumpable" or "mixable" are used interchangeably herein and refer to a fluid or slurry that has either a yield stress or low-shear (5.11 $s^{-1}$) viscosity less than 1000 Pa and a dynamic apparent viscosity of less than 10 Pa-s (10,000 cP) at a shear rate 170 $s^{-1}$, where yield stress, low-shear viscosity and dynamic apparent viscosity are measured at a temperature of 25° C. unless another temperature is specified explicitly or in context of use.

"Viscosity" as used herein unless otherwise indicated refers to the apparent dynamic viscosity of a fluid at a temperature of 25° C. and shear rate of 170 $s^{-1}$. The measurement or determination of the viscosity of the liquid phase (as opposed to the treatment fluid or base fluid) may be based on a direct measurement of the solids-free liquid, or a calculation or correlation based on a measurement(s) of the characteristics or properties of the liquid containing the solids, or a measurement of the solids-containing liquid using a technique where the determination of viscosity is not affected by the presence of the solids. As used herein, solids-free for the purposes of determining the viscosity of the liquid phase means in the absence of non-colloidal particles larger than 1 micron such that the particles do not affect the viscosity determination, but in the presence of any submicron or colloidal particles that may be present to thicken and/or form a gel with the liquid, i.e., in the presence of ultrafine particles that can function as a thickening agent. In some embodiments, a "low viscosity liquid phase" means a viscosity less than about 300 mPa-s measured without any solids greater than 1 micron at 170 $s^{-1}$ and 25° C.

The terms "energized fluid" and "foam" refer to a fluid which when subjected to a low pressure environment liberates or releases gas from solution or dispersion, for example, a liquid containing dissolved gases. Foams or energized fluids are stable mixtures of gases and liquids that form a two-phase system. Foam and energized fluids are generally described by their foam quality, i.e. the ratio of gas volume to the foam volume (fluid phase of the treatment fluid), i.e., the ratio of the gas volume to the sum of the gas plus liquid volumes). If the foam quality is between 52% and 95%, the energized fluid is usually called foam. Above 95%, foam is generally changed to mist. In the present patent application, the term "energized fluid" also encompasses foams and refers to any stable mixture of gas and liquid, regardless of the foam quality. In embodiments, the foam quality is from 20% to 95%, it may be from 50 to 90%, it may also be from 70 to 92%. Energized fluids comprise any of:

(a) Liquids that at bottom hole conditions of pressure and temperature are close to saturation with a species of gas. For example the liquid can be aqueous and the gas nitrogen or carbon dioxide. Associated with the liquid and gas species and temperature is a pressure called the bubble point, at which the liquid is fully saturated. At pressures below the bubble point, gas emerges from solution;

(b) Foams, consisting generally of a gas phase, an aqueous phase and a solid phase. At high pressures the foam quality is typically low (i.e., the non-saturated gas volume is low), but quality (and volume) rises as the pressure falls. Additionally, the aqueous phase may have originated as a solid material and once the gas phase is dissolved into the solid phase, the viscosity of solid material is decreased such that the solid material becomes a liquid; or (c) Liquefied gases.

In some embodiments, the energized carrier fluid may have a density, depending on the foam quality and the density of the liquid and gaseous components for example, from 0.05 to 1.2 g/mL, or less than 1.1 g/mL, or less than 1 g/mL, or less than 0.9 g/mL, or less than 0.8 g/mL, or less than 0.7 g/mL, or less than 0.6 g/mL, or less than 0.5 g/mL, or less than 0.4 g/mL, or less than 0.3 g/mL, or less than 0.2 g/mL, or less than 0.1 g/mL.

The treatment fluid may additionally or alternatively include, without limitation, friction reducers, clay stabilizers, biocides, crosslinkers, breakers, corrosion inhibitors, and/or proppant flowback control additives. The treatment fluid may further include a product formed from degradation, hydrolysis, hydration, chemical reaction, or other process that occur during preparation or operation.

In embodiments, the energized fluid, that at the time of injecting, possesses a property inconsistent with channelization and subsequently is transformed to be consistent with channelization. For example, the treatment slurry may have a viscosity, at the time of injecting, such that it enables the placement of solid particulates into a void, e.g. greater than 50 cP at 100 $s^{-1}$ and at the same time a viscosity such that it minimizes the chance of channelization via settling, e.g. greater than 500,000 cP at 0.001 to 1 $s^{-1}$. Subsequently, the viscosity may be changed, e.g., by introduction of a viscosity breaker such that the viscosity is consistent with channelization. In yet a further embodiment, the energized fluid may contain a combination of two or more liquid phase, for example a crosslinked gel and a linear gel, wherein, at the time of injecting, at least one of the phases is inconsistent with channelization and at least one of the phases is consistent with channelization. In such embodiments, subsequent to the injecting, those fluids inconsistent with channelization may be destroyed or broken thereby allowing channelization to occur. Examples of such systems may be solutions of crosslinked guar and viscoelastic surfactants wherein de-crosslinking may occur by lowering the pH or by addition of oxidative breakers. Another example may be solutions of crosslinked guar with borate and polyacrylamide polymers. The breaking may be done by using an oxidative breaker or by using a delayed agent such as for example an acid precursor. Different types of breaker may be combined in order to break the gel in successive phase. The breaking of the gel will typically result in the destabilization of the energized fluid thus promoting the formation of cluster. Thereafter, during fracture closure, the pressure applied will even further strengthen the strength of such clusters and/or pillars.

The liquid phase of the fluid suitable for use in all embodiments of the disclosed subject matter include any fluid useful in fracturing fluids, including, without limitation, gels, slickwater, and viscoelastic surfactants. In further embodiments, the carrying fluids may comprise linear fluids, e.g. non-crosslinked fluids.

In an alternative, all embodiments disclosed may contain a liquid phase of the fluid comprising a crosslinked fluid such as a crosslinked polysaccharide and/or crosslinked polyacrylamide. Any appropriate cross linking agent may be used in forming the crosslinked fluid, including, for example, boron and its salts, salts or other compounds of transition metals such as chromium and copper, titanium, antimony, aluminum, zirconium, and organic crosslinkers, such as glutaraldehyde.

In an alternative, all embodiments disclosed the liquid phase of the fluid may be a viscoelastic surfactant (VES) or emulsion. In further embodiments, the slurry or composition further comprises one or more breaker additives for reducing the viscosity of the liquid phase.

As used herein, a "water soluble polymer" refers to a polymer which has a water solubility of at least 5 wt % (0.5 g polymer in 9.5 g water) at 25° C.

In some embodiments, the treatment fluid may include a continuous fluid phase, also referred to as an external phase, and a discontinuous phase(s), also referred to as an internal phase(s), which may be a fluid (liquid or gas) in the case of an emulsion, foam or energized fluid, or which may be a solid in the case of a slurry. The continuous fluid phase, also referred to herein as the carrier fluid or comprising the carrier fluid, may be any matter that is substantially continuous under a given condition. Examples of the continuous fluid phase include, but are not limited to, water, hydrocarbon, gas (e.g., nitrogen or methane), liquefied gas (e.g., propane, butane, or the like), etc., which may include solutes, e.g. the fluid phase may be a brine, and/or may include a brine or other solution(s). In some embodiments, the fluid phase(s) may optionally include a viscosifying and/or yield point agent and/or a portion of the total amount of viscosifying and/or yield point agent present. Some non-limiting examples of the fluid phase(s) include hydratable gels and mixtures of hydratable gels (e.g. gels containing polysaccharides such as guars and their derivatives, xanthan and diutan and their derivatives, hydratable cellulose derivatives such as hydroxyethylcellulose, carboxymethylcellulose and others, polyvinyl alcohol and its derivatives, other hydratable polymers, colloids, etc.), a crosslinked hydratable gel, a viscosified acid (e.g. gel-based), an emulsified acid (e.g. oil outer phase), an energized fluid (e.g., an $N_2$ or $CO_2$ based foam), a viscoelastic surfactant (VES) viscosified fluid, and an oil-based fluid including a gelled, foamed, or otherwise viscosified oil.

The discontinuous phase if present in the treatment fluid may be any particles (including fluid droplets) that are suspended or otherwise dispersed in the continuous phase in a disjointed manner. In this respect, the discontinuous phase can also be referred to, collectively, as "particle" or "particulate" which may be used interchangeably. As used herein, the term "particle" should be construed broadly. For example, in some embodiments, the particle(s) of the current application are solid such as proppant, sands, ceramics, crystals, salts, etc.; however, in some other embodiments, the particle(s) can be liquid, gas, foam, emulsified droplets, etc. Moreover, in some embodiments, the particle(s) of the current application are substantially stable and do not change shape or form over an extended period of time, temperature, or pressure; in some other embodiments, the particle(s) of the current application are degradable, expandable, swellable, dissolvable, deformable, meltable, sublimeable, or otherwise capable of being changed in shape, state, or structure.

In some embodiments, the anchorant is pumped in a stabilized solid laden slurry. Such stabilized laden slurry may be used as the solid particles containing slurry during the job or just during transportation and would thus be diluted when arriving on site. "Stable" or "stabilized" or similar terms refer to a concentrated blend slurry (CBS) wherein gravitational settling of the particles is inhibited such that no or minimal free liquid is formed, and/or there is no or minimal rheological variation among strata at different depths in the CBS, and/or the slurry may generally be regarded as stable over the duration of expected CBS storage and use conditions, e.g., a CBS that passes a stability test or an equivalent thereof. In an embodiment, stability can be evaluated following different settling conditions, such as for example static under gravity alone, or dynamic under a vibratory influence, or dynamic-static conditions employing at least one dynamic settling condition followed and/or preceded by at least one static settling condition.

The static settling test conditions can include gravity settling for a specified period, e.g., 24 hours, 48 hours, 72 hours, or the like, which are generally referred to with the respective shorthand notation "24 h-static", "48 h-static" or "72 h static". Dynamic settling test conditions generally indicate the vibratory frequency and duration, e.g., 4 h@15 Hz (4 hours at 15 Hz), 8 h@5 Hz (8 hours at 5 Hz), or the like. Dynamic settling test conditions are at a vibratory amplitude of 1 mm vertical displacement unless otherwise indicated. Dynamic-static settling test conditions will indicate the settling history preceding analysis including the total duration of vibration and the final period of static conditions, e.g., 4 h@15 Hz/20 h-static refers to 4 hours vibration followed by 20 hours static, or 8 h@15 Hz/10 d-static refers to 8 hours total vibration, e.g., 4 hours vibration followed by 20 hours static followed by 4 hours vibration, followed by 10 days of static conditions. In the absence of a contrary indication, the designation "8 h@15 Hz/10 d-static" refers to the test conditions of 4 hours vibration, followed by 20 hours static followed by 4 hours vibration, followed by 10 days of static conditions. In the absence of specified settling conditions, the settling condition is 72 hours static. The stability settling and test conditions are at 25° C. unless otherwise specified.

As used herein, a concentrated blend slurry (CBS) may meet at least one of the following conditions:

(1) the slurry has a low-shear viscosity equal to or greater than 1 Pa-s (5.11 $s^{-1}$, 25° C.);

(2) the slurry has a Herschel-Bulkley (including Bingham plastic) yield stress (as determined in the manner described herein) equal to or greater than 1 Pa; or (3) the largest particle mode in the slurry has a static settling rate less than 0.01 mm/hr; or (4) the depth of any free fluid at the end of a 72-hour static settling test condition or an 8 h@15 Hz/10 d-static dynamic settling test condition (4 hours vibration followed by 20 hours static followed by 4 hours vibration followed finally by 10 days of static conditions) is no more than 2% of total depth; or (5) the apparent dynamic viscosity (25° C., 170 $s^{-1}$) across column strata after the 72-hour static settling test condition or the 8 h@15 Hz/10 d-static dynamic settling test condition is no more than +/−20% of the initial dynamic viscosity; or (6) the slurry solids volume fraction (SVF) across the column strata below any free water layer after the 72-hour static settling test condition or the 8 h@15 Hz/10 d-static dynamic settling test condition is no more than 5% greater than the initial SVF; or (7) the density across the column strata below any free water layer after the 72-hour static settling test condition or the 8 h@15 Hz/10 d-static dynamic settling test condition is no more than 1% of the initial density.

In some embodiments, the concentrated blend slurry comprises at least one of the following stability indicia: (1) an SVF of at least 0.4 up to SVF=PVF; (2) a low-shear viscosity of at least 1 Pa-s (5.11 $s^{-1}$, 25° C.); (3) a yield stress (as determined herein) of at least 1 Pa; (4) an apparent viscosity of at least 50 mPa-s (170 $s^{-1}$, 25° C.); (5) a multimodal solids phase; (6) a solids phase having a PVF greater than 0.7; (7) a viscosifier selected from viscoelastic surfactants, in an amount ranging from 0.01 up to 7.2 g/L (60 ppt), and hydratable gelling agents in an amount ranging from 0.01 up to 4.8 g/L (40 ppt) based on the volume of fluid phase; (8) colloidal particles; (9) a particle-fluid density delta less than 1.6 g/mL, (e.g., particles having a specific gravity less than 2.65 g/mL, carrier fluid having a density greater than 1.05 g/mL or a combination thereof); (10) particles having an aspect ratio of at least 6; (11) ciliated or coated proppant; and (12) combinations thereof.

In an embodiment, the concentrated blend slurry is formed (stabilized) by at least one of the following slurry stabilization operations: (1) introducing sufficient particles into the slurry or treatment fluid to increase the SVF of the treatment fluid to at least 0.4; (2) increasing a low-shear viscosity of the slurry or treatment fluid to at least 1 Pa-s (5.11 $s^{-1}$, 25° C.); (3) increasing a yield stress of the slurry or treatment fluid to at least 1 Pa; (4) increasing apparent viscosity of the slurry or treatment fluid to at least 50 mPa-s (170 $s^{-1}$, 25° C.); (5) introducing a multimodal solids phase into the slurry or treatment fluid; (6) introducing a solids phase having a PVF greater than 0.7 into the slurry or treatment fluid; (7) introducing into the slurry or treatment fluid a viscosifier selected from viscoelastic surfactants, e.g., in an amount ranging from 0.01 up to 7.2 g/L (60 ppt), and hydratable gelling agents, e.g., in an amount ranging from 0.01 up to 4.8 g/L (40 ppt) based on the volume of fluid phase; (8) introducing colloidal particles into the slurry or treatment fluid; (9) reducing a particle-fluid density delta to less than 1.6 g/mL (e.g., introducing particles having a specific gravity less than 2.65 g/mL, carrier fluid having a density greater than 1.05 g/mL or a combination thereof); (10) introducing particles into the slurry or treatment fluid having an aspect ratio of at least 6; (11) introducing ciliated or coated proppant into slurry or treatment fluid; and (12) combinations thereof. The slurry stabilization operations may be separate or concurrent, e.g., introducing a single viscosifier may also increase low-shear viscosity, yield stress, apparent viscosity, etc., or alternatively or additionally with respect to a viscosifier, separate agents may be added to increase low-shear viscosity, yield stress and/or apparent viscosity.

Increasing carrier fluid viscosity in a Newtonian fluid also proportionally increases the resistance of the carrier fluid motion. In some embodiments, the carrier fluid has a lower limit of apparent dynamic viscosity, determined at 170 $s^{-1}$ and 25° C., of at least about 10 mPa-s, or at least about 25 mPa-s, or at least about 50 mPa-s, or at least about 75 mPa-s, or at least about 100 mPa-s, or at least about 150 mPa-s, or at least about 300 mPa-s, or at least about 500 mPa-s. A disadvantage of increasing the viscosity is that as the viscosity increases, the friction pressure for pumping the slurry generally increases as well. In some embodiments, the fluid carrier has an upper limit of apparent dynamic viscosity, determined at 170 $s^{-1}$ and 25° C., of less than about 1000 mPa-s, or less than about 500 mPa-s, or less than about 300 mPa-s, or less than about 150 mPa-s, or less than about 100 mPa-s, or less than about 50 mPa-s. In an embodiment, the fluid phase viscosity ranges from any lower limit to any higher upper limit.

In some embodiments, an agent may both viscosify and impart yield stress characteristics, and in further embodiments may also function as a friction reducer to reduce friction pressure losses in pumping the treatment fluid. In an embodiment, the liquid phase is essentially free of viscosifier or comprises a viscosifier in an amount ranging from 0.01 up to 12 g/L (0.08-100 ppt) of the fluid phase. The viscosifier can be a viscoelastic surfactant (VES) or a hydratable gelling agent such as a polysaccharide, which may be crosslinked. When using viscosifiers and/or yield stress fluids, proppant settling in some embodiments may be triggered by breaking the fluid using a breaker(s). In some embodiments, the slurry is stabilized for storage and/or pumping or other use at the surface conditions and proppant transport and placement, and settlement triggering is achieved downhole at a later time prior to fracture closure, which may be at a higher temperature, e.g., for some formations, the temperature difference between surface and downhole can be significant and useful for triggering degradation of the viscosifier, any stabilizing particles (e.g., subproppant particles) if present, a yield stress agent or characteristic, and/or a activation of a breaker. Thus in some embodiments, breakers that are either temperature sensitive or time sensitive, either through delayed action breakers or delay in mixing the breaker into the slurry to initiate destabilization of the slurry and/or proppant settling, can be useful.

In embodiments, the fluid may include leakoff control agents, such as, for example, latex dispersions, water soluble polymers, submicron particulates, particulates with an aspect ratio higher than 1, or higher than 6, combinations thereof and the like, such as, for example, crosslinked polyvinyl alcohol microgel. The fluid loss agent can be, for example, a latex dispersion of polyvinylidene chloride, polyvinyl acetate, polystyrene-co-butadiene; a water soluble polymer such as hydroxyethylcellulose (HEC), guar, copolymers of polyacrylamide and their derivatives; particulate fluid loss control agents in the size range of 30 nm to 1 micron, such as γ-alumina, colloidal silica, $CaCO_3$, $SiO_2$, bentonite etc.; particulates with different shapes such as glass fibers, flocs, flakes, films; and any combination thereof or the like. Fluid loss agents can if desired also include or be used in combination with acrylamido-methyl-propane sulfonate polymer (AMPS). In an embodiment, the leak-off control agent comprises a reactive solid, e.g., a hydrolyzable material such as PGA, PLA or the like; or it can include a soluble or solubilizable material such as a wax, an oil-soluble resin, or another material soluble in hydrocarbons, or calcium carbonate or another material soluble at low pH; and so on. In an embodiment, the leak-off control agent comprises a reactive solid selected from ground quartz, oil soluble resin, degradable rock salt, clay, zeolite or the like. In other embodiments, the leak-off control agent comprises one or more of magnesium hydroxide, magnesium carbonate, magnesium calcium carbonate, calcium carbonate, aluminum hydroxide, calcium oxalate, calcium phosphate, aluminum metaphosphate, sodium zinc potassium polyphosphate glass, and sodium calcium magnesium polyphosphate glass, or the like. The treatment fluid may also contain colloidal particles, such as, for example, colloidal silica, which may function as a loss control agent, gellant and/or thickener.

The treatment fluid may be prepared on location, e.g., at the wellsite when and as needed using conventional treatment fluid blending equipment.

In some embodiment, there is provided a wellsite equipment configuration for a land-based fracturing operation using the principles disclosed herein. The proppant is contained in sand trailers. Anchorants may also be contained in a trailer. Water tanks are arranged along one side of the operation site. Hopper receives sand from the sand trailers and distributes it into the mixer truck. Blender is provided to blend the carrier medium (such as brine, viscosified fluids, etc.) with the proppant, i.e., "on the fly," and then the slurry is discharged to manifold. The final mixed and blended slurry, also called frac fluid, is then transferred to the pump trucks, and routed at treatment pressure through treating line to rig, and then pumped downhole. This configuration eliminates the additional mixer truck(s), pump trucks, blender(s), manifold(s) and line(s) normally required for slickwater fracturing operations, and the overall footprint is considerably reduced.

In some embodiments, the wellsite equipment configuration may be provided with the additional feature of delivery of pump-ready treatment fluid delivered to the wellsite in trailers to and further elimination of the mixer, hopper, and/or blender. In some embodiments the treatment fluid is prepared offsite and pre-mixed with proppant, anchors and other additives, or with some or all of the additives except proppant, such as in a system described in co-pending co-assigned patent applications with application Ser. No. 13/415,025, filed on Mar. 8, 2012, and application Ser. No. 13/487,002, filed on Jun. 1, 2012, the entire contents of which are incorporated herein by reference in their entireties. As used herein, the term "pump-ready" should be understood broadly. In certain embodiments, a pump-ready treatment fluid means the treatment fluid is fully prepared and can be pumped downhole without being further processed. In some other embodiments, the pump-ready treatment fluid means the fluid is substantially ready to be pumped downhole except that a further dilution may be needed before pumping or one or more minor additives need to be added before the fluid is pumped downhole. In such an event, the pump-ready treatment fluid may also be called a pump-ready treatment fluid precursor. In some further embodiments, the pump-ready treatment fluid may be a fluid that is substantially ready to be pumped downhole except that certain incidental procedures are applied to the treatment fluid before pumping, such as low-speed agitation, heating or cooling under exceptionally cold or hot climate, etc.

Figure 2:
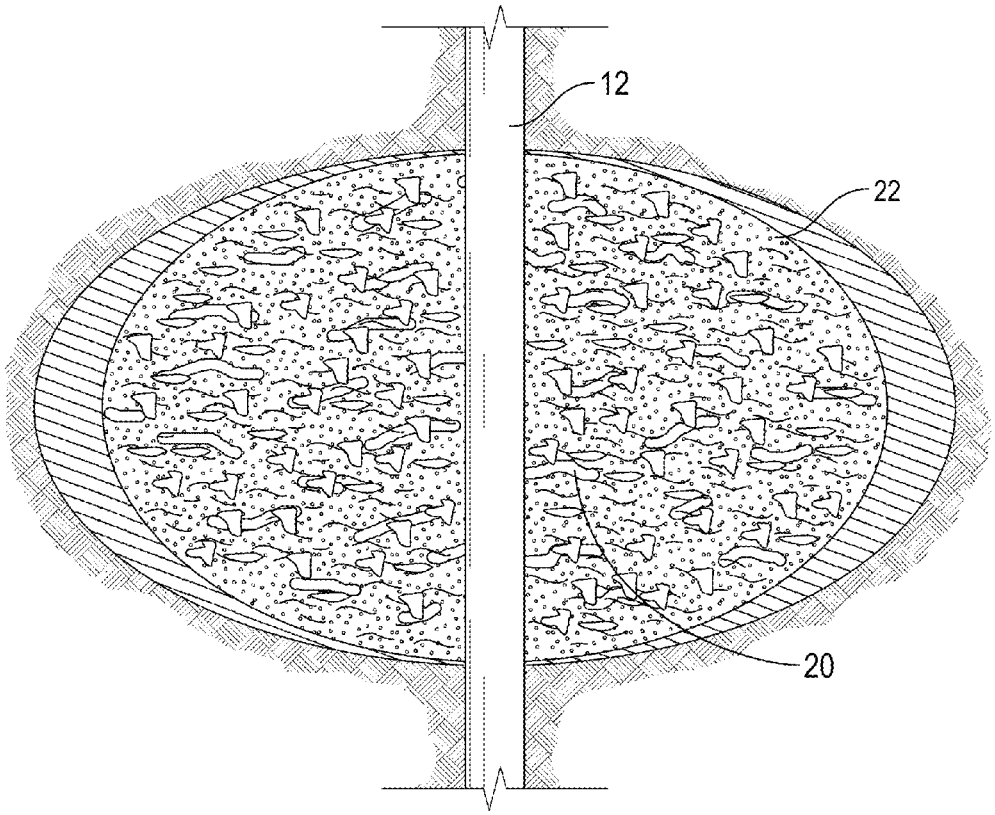
FIG. 2 is a schematic illustrating the proppant slurry of FIG. 1 after in situ channelization during heterogeneous settling inside a hydraulic fracture according to some embodiments of the present disclosure.
Figure 3A:
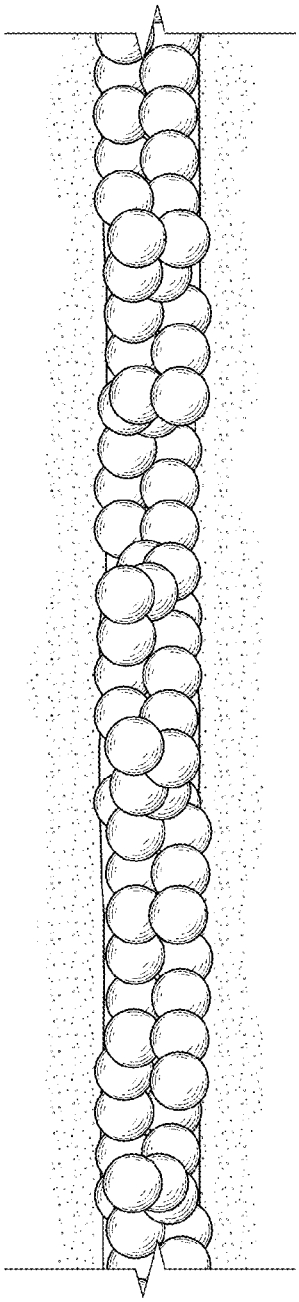
FIG. 3A (Prior Art)
FIG. 3A (prior art) illustrates a propped fracture after a conventional treatment with homogeneous proppant settling.
Figure 3B:
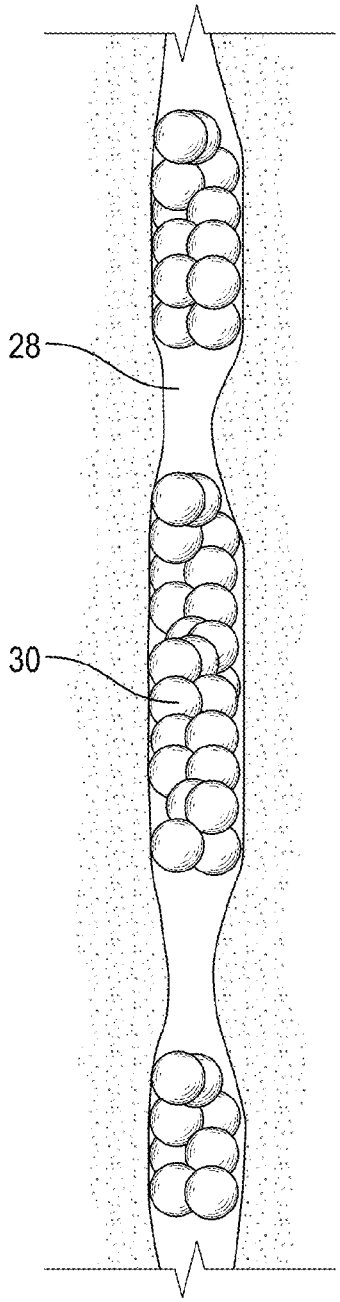
FIG. 3B schematically illustrates a propped fracture after a treatment with heterogeneous proppant settling according to some embodiments of the present disclosure.

In embodiments a pad substage fluid, the in situ channelization treatment fluid, the energized in situ channelization treatment fluid, or another fluid is pumped above the fracture pressure to form a fracture in the formation, the in situ channelization treatment fluid and/or the energized in situ channelization treatment fluid carrying solid particles; once placed, the fluid is allowed to destabilize in the fracture thus forming highly conductive channels by means of proppant settling in the presence of anchorants during the destabilization of said fluid. Without wishing to be bound by any theory, it is believed that formation of such channels may be accomplished by redistributing of propping agent in a said fracturing fluid during its anchor-assisted non-homogeneous settling. Such non-homogeneous settling yields formation of "islands" and/or "pillars" of proppant-rich clusters surrounded by substantially proppant-free fluid. This phenomenon is summarized in FIGS. 1 and 2. FIG. 1 displays the state of the particles laden energized fluid 10 just after placement, through a wellbore 12 in the fracture 14 created in the formation 16, whereas FIG. 2 is a schematic of the formation of the pillars during the destabilization of the energized fluid; it is readily apparent that the fluid is destabilized leaving some proppant-rich clusters 20 which include the anchors. Moreover, it is believed that the destabilization of the energized fluid and/or foamed fluid, if used, results in creation of gas bubbles 22 which are getting entrapped into the structure of these proppant rich clusters 20 increasing their stability to settling, as evidenced in Example 1 below (see FIG. 23). Further fracture closure results in the creation of highly conductive channels 28 between the proppant clusters 30, as shown in FIG. 3B. Obtained fractures have significantly higher fracture conductivity than fractures propped with a conventional fracture treatment with homogeneous proppant settling, as shown in FIG. 3A.

Figure 4:
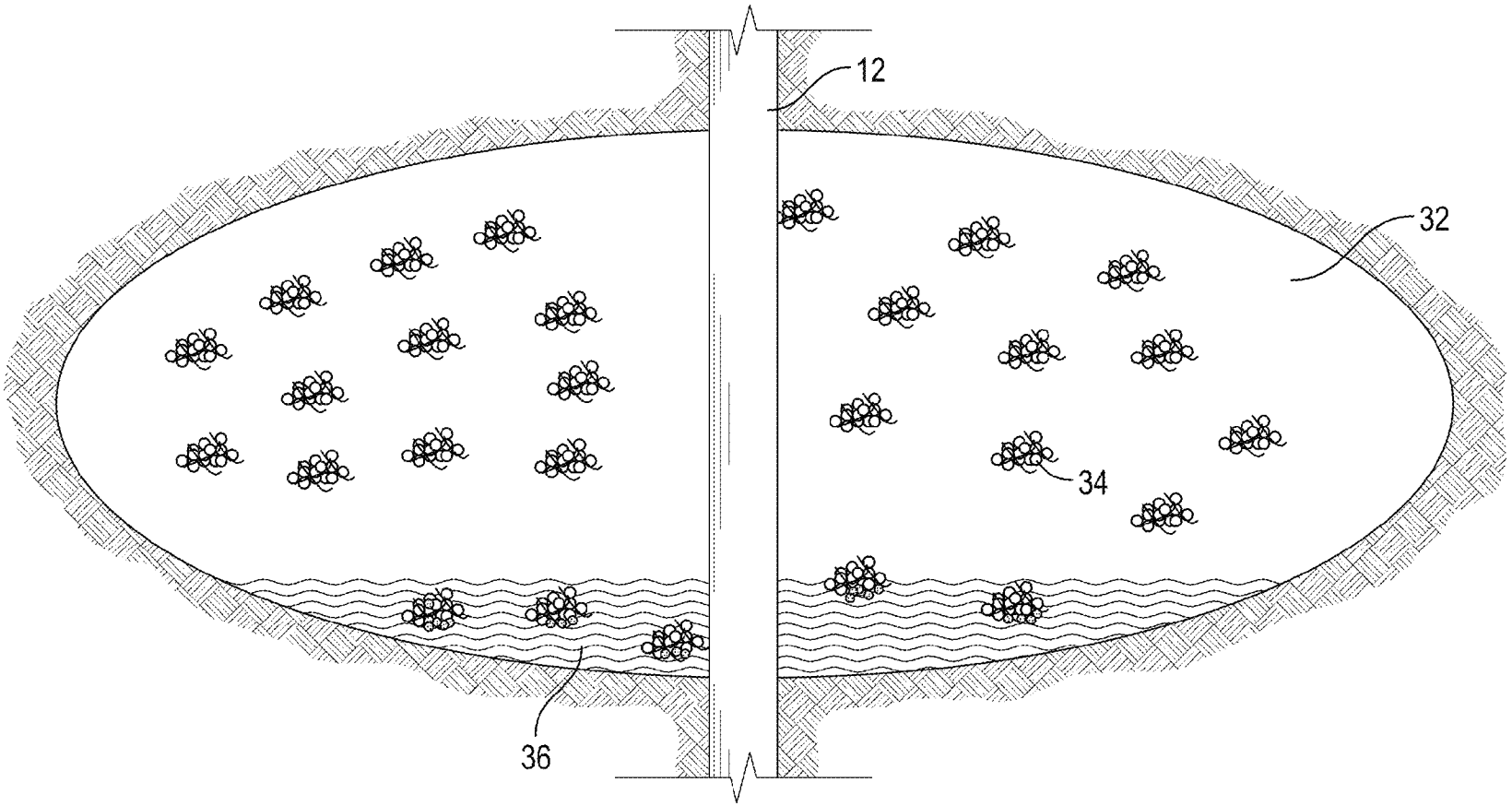
FIG. 4 shows the profile of a fracture after destabilization of the energized fluid according to the present application according to some embodiments of the present disclosure.

In embodiments, when the energized fluid, if present, is of high initial foam quality, such as higher than 70% foam, its destabilization may result in forming of a substantially clean portion (liquid-free) of a fracture with distributed clusters of solids and a portion of a fracture containing liquid phase corresponding to the destabilized foam. The productivity of such fracture, after closure, is typically very high thanks to the high level of clean up. This is schematically exemplified in FIG. 4. Upon destabilization of the in situ channelization treatment fluid the stability of the proppant clusters 34 in the substantially proppant-free portion(s) 32 of the fracture may additionally be supported by capillary forces. Such forces are caused by small portion of liquid phase left in structure of the said proppant clusters. These capillary forces may be controlled by introducing wettability agents known to those skilled in the art.

With reference to FIGS. 5A-8B, in embodiments the downhole completion staging system or tool, used with or in the in situ channelization treatment fluid, the energized in situ channelization treatment fluid, the pad substage fluid, the flush substage fluid, or another treatment fluid, comprises a sleeve-based system to open fracturing ports. Generally, sliding sleeves in the closed position are fitted to the production liner. The production liner is placed in a hydrocarbon formation. An object is introduced into the wellbore from surface, and the object is transported to the target zone by the flow field in the in situ channelization treatment fluid, the energized in situ channelization treatment fluid, the pad substage fluid, the flush substage fluid, or another treatment fluid. When at the target location, the object is caught by the sliding sleeve and shifts the sleeve to the open position. The object remains in the sleeve, obstructing hydraulic communication from above to below. A fracture treatment, e.g., the in situ channelization treatment fluid, the energized in situ channelization treatment fluid, the pad substage fluid, the flush substage fluid, or another treatment fluid, is then circulated down the wellbore to the formation adjacent the open sleeve. In embodiments the fracture treatment is circulated into the wellbore with the in situ channelization treatment fluid, or with the energized in situ channelization treatment fluid. Representative examples of sleeve-based systems are disclosed in U.S. Pat. Nos. 7,387,165, 7,322,417, 7,377,321, US 2007/0107908, US 2007/0044958, US 2010/0209288, U.S. Pat. No. 7,387,165, US2009/0084553, U.S. Pat. Nos. 7,108,067, 7,431,091, 7,543,634, 7,134,505, 7,021,384, 7,353,878, 7,267,172, 7,681,645, 7,066,265, 7,168,494, 7,353,879, 7,093,664, and 7,210,533, which are hereby incorporated herein by reference.

FIGS. 5A-5E illustrate embodiments employing a TREAT AND PRODUCE (TAP) cased hole system disclosed in U.S. Pat. Nos. 7,387,165, 7,322,417, 7,377,321. Briefly the system includes a series of valves 60 for isolating multiple production zones. Each valve 60 includes a valve sleeve 62 moveable between a closed position blocking radial openings in an outer housing 64 and an open position where the radial openings are exposed. The valve 60 also includes a piston 66 and a collapsible seat 68 which is movable between a pass through state, allowing a ball or dart to pass through it, and a ball or dart catching state.

Figure 5A:
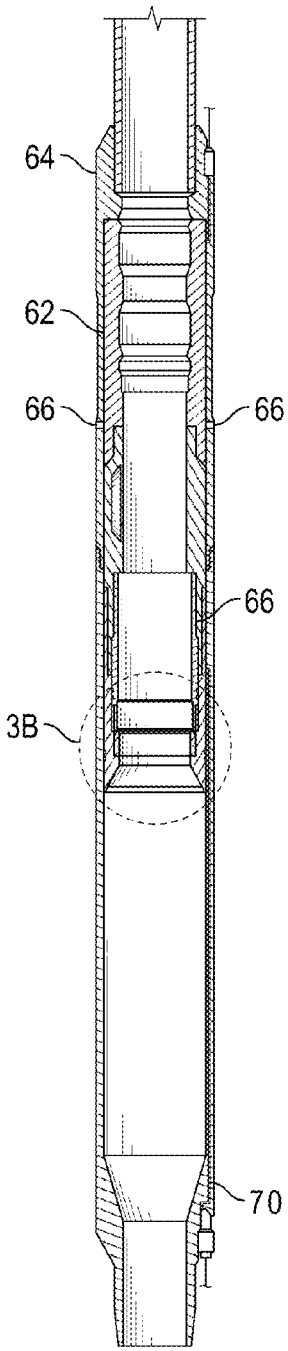
FIGS. 5A-5E schematically illustrate a sleeve-based completion staging system tool according to some embodiments of the present disclosure.
Figure 5B:
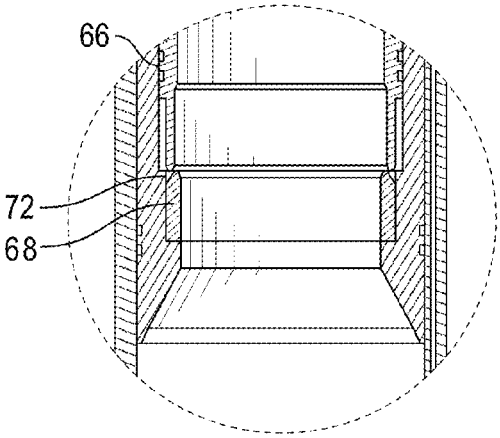
Figure 5C:
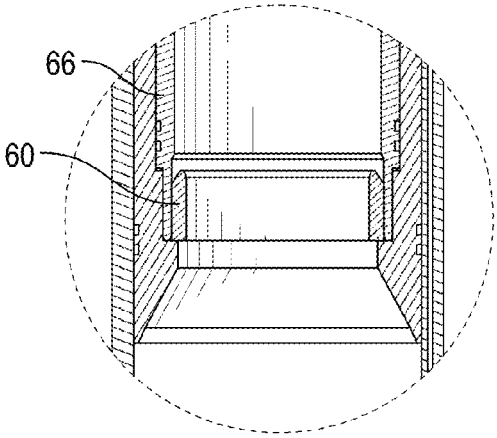
Figure 5D:
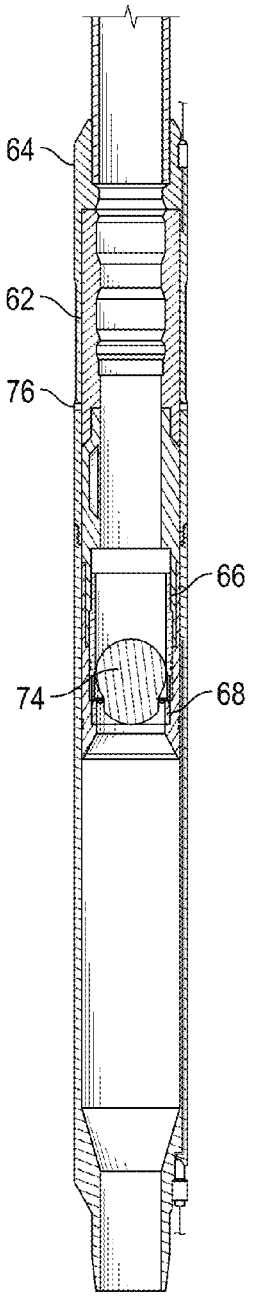

To isolate a zone, first the seat 68 is collapsed by increasing pressure through control line 70 to move piston 66 downwardly as shown viewing FIGS. 5B and 5C together. This downward movement causes mating slanted surfaces 72 of the piston 66 and C-ring 68 to interact to close the C-ring. The C-ring is now in position to catch a ball or dart as shown in FIG. 5D. Dart 74 can now be dropped and caught by C-ring 68. The dart 74 and C-ring 68 now form a fluid tight barrier. Pumping fluid against the dart 74 shears a pin 76 allowing the valve sleeve 62 to move downwardly and out of blocking engagement with the radial openings. A treatment fluid can then be injected through the fracture port openings and into the formation.

Figure 5E:
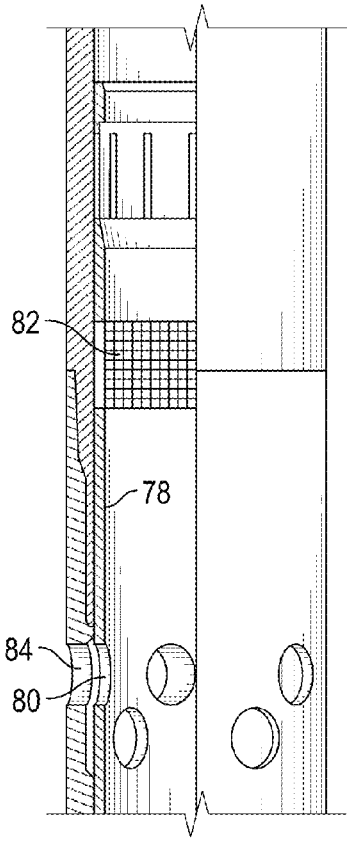

In different embodiments shown in FIG. 5E, the sleeve 78 includes a first set of ports 80 and another set of ports adjacent to a filter 82. This assembly works exactly like the one in FIGS. 5A-5D except with pressure down on the dart there are two positions: an open valve "treating" position where ports 80 and 84 are aligned, and an open port producing position where the filter 82 is adjacent to ports 84 to inhibit proppant or sand from leaving the formation.

Figure 6A:
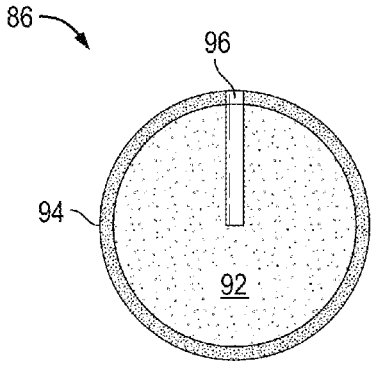
FIGS. 6A-6C schematically illustrate activating objects used in a sleeve-based completion staging system or tool according to some embodiments of the present disclosure.
Figure 6B:
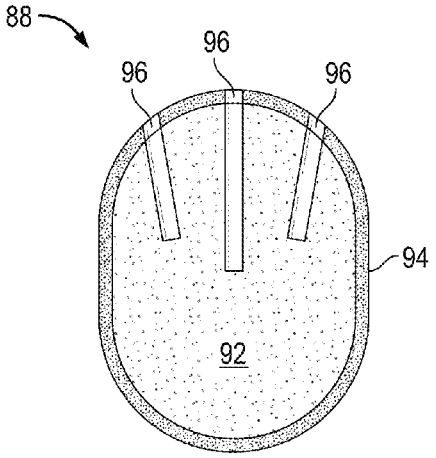
Figure 6C:
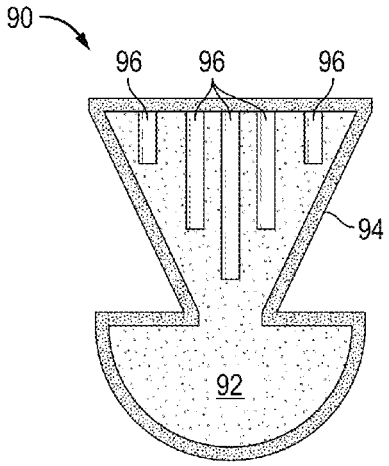

FIGS. 6A-6C illustrate embodiments for dissolvable materials as disclosed in US 2007/0107908, US 2007/0044958, and US 2010/0209288. Briefly, a ball 86, 88 or a dart 90 is made up of inner material 92 which is a combination of an insoluble metal and a soluble additive so that the combination forms a high strength material that is dissolvable in an aqueous solution. This inner material 92 is then coated with an insoluble protective layer 94 to delay the dissolution. The ball 88, 90 or dart 92 may include openings 96 drilled into the ball to allow dissolving of the ball or dart to begin immediately upon dropping the ball into the well in the in situ channelization treatment fluid, the energized in situ channelization treatment fluid, the pad substage fluid, the flush substage fluid, or another treatment fluid. The rate of dissolution of the ball 10, 20 or dart 30 can be controlled by altering the type and amount of the additive or altering the number or size of the openings 16.

Figure 6D:
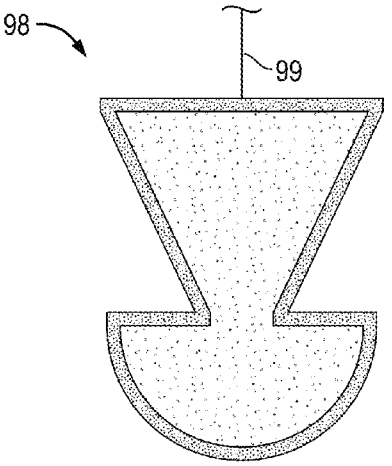
FIG. 6D schematically illustrates an activating object with a wireline to relay information from the object to the surface according to some embodiments of the present disclosure.

In FIG. 6D the object 98 shown as a dart may optionally be attached to a wireline to relay information from the dart or other object 98, such as its location, operating status, transition status, pressure, temperature, etc., to the surface. The balls 86, 88 and/or darts 90, 98 may optionally be or include one of the autonomous objects discussed below in connection with any one of FIGS. 9-22.

Figure 7A:
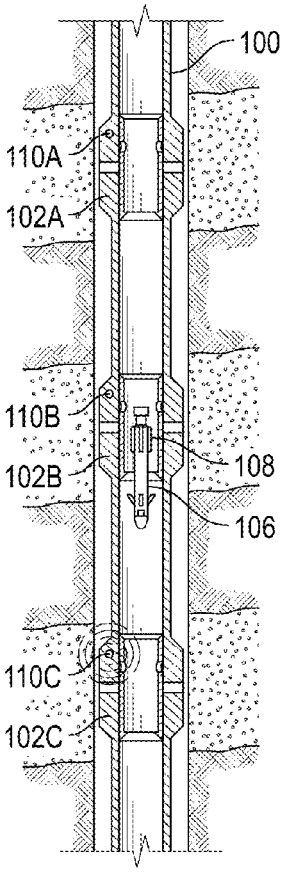
FIGS. 7A-7C schematically illustrate an RFID based dart-sleeve completion staging system tool according to some embodiments of the present disclosure.
Figure 7B:
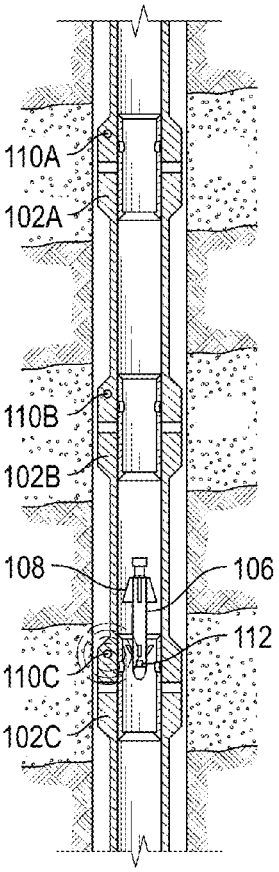
Figure 7C:
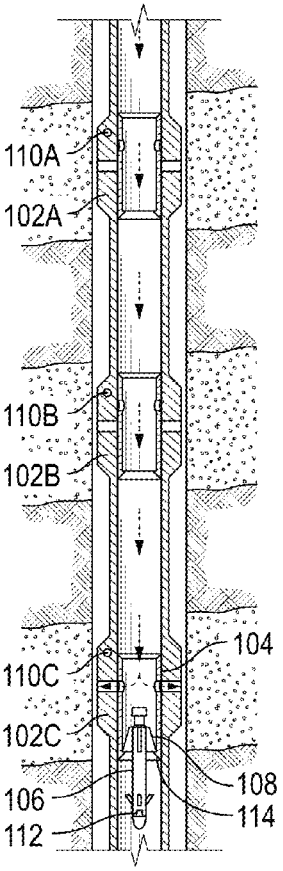

FIGS. 7A-7C illustrate a smart dart system disclosed in U.S. Pat. No. 7,387,165, US2009/0084553, but may also be applicable to employment of autonomous devices as discussed below. Briefly, in these embodiments a casing 100 is cemented in place and a number of valves 102A-C are provided integral with the casing. Each valve 102A-C has a movable sleeve 104 (see FIG. 7C) and seat of the same size. However, in some embodiments the seat is not collapsible. Instead, the dart 106 is deployed in the in situ channelization treatment fluid, the energized in situ channelization treatment fluid, the pad substage fluid, the flush substage fluid, or another treatment fluid, in a radially contracted state, which is activated, upon reaching the particular valve 102A-C to be opened, to transition to a radially expanded state to engage a capture feature associated with the valve. The transition to the radially expanded state may employ fins 108 as illustrated, or another radially expanding mechanism such as a C-ring, balloon, or the like. For example, the dart 106 may be deployed with its fins 108 collapsed. To actuate the fins in these embodiments, each valve 102A-C has a transmitter 110A-C which emits a unique RF signal, and each dart in turn includes a receiver 112 for receiving a particular target RF signal. As the dart 106 comes into proximity with a valve emitting its target RF signal, the fins 108 spring radially outwardly into a position to engage a seat and form a seal. Continuing to pump down on the dart then enables the sleeve 114 to be lowered to expose a fracture port and allow the fracture treatment fluid to enter the formation.

Figure 8B:
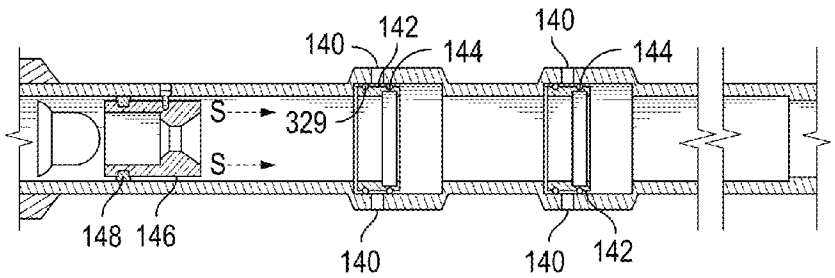
FIGS. 8A-8B schematically illustrate a further sleeve-based completion staging system or tool according to some embodiments of the present disclosure.
Figure 8A:
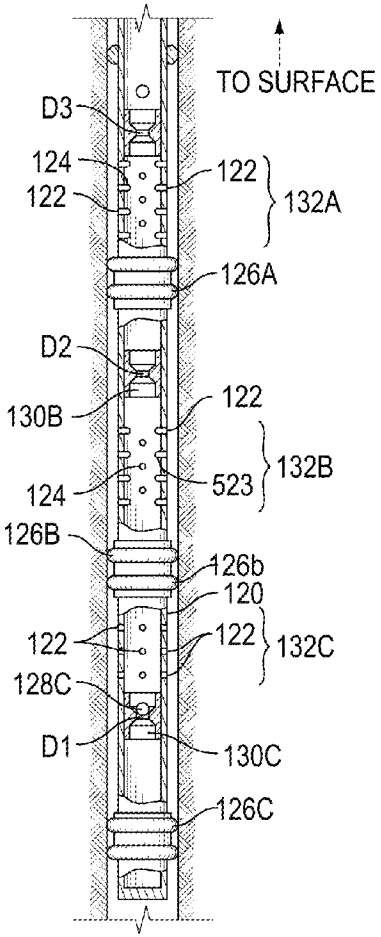

The multistage system shown in FIGS. 8A-8B is an open hole system. With reference to FIG. 8A, the assembly includes a tubing 120 with preformed ports 122 that are covered by shearable end caps 124. The tubing 120 is run in hole with all of the ports covered and then packers 126A-C are set to isolate various zones of interest in the formation. When ready to stimulate, a ball 128C is dropped from surface in the in situ channelization treatment fluid, the energized in situ channelization treatment fluid, the pad substage fluid, the flush substage fluid, or another treatment fluid to seat into seat D1 in sliding sleeve 130C, thus creating a barrier in the sliding sleeve. Fluid can then be pumped down on the ball 128C to push the sliding sleeve 130C downwardly to shear the end caps 124 in the area of ported interval 132C. With these end caps sheared, ports 122 in the area of ported interval 132C are opened, and the ball/sleeve interface creates a barrier below the ported interval 132C. Thus, a treatment fluid can be directed through the ports 122 in ported interval 132C and packers 126B and 126C will isolate the flow to the adjacent formation in the area of ported interval 132C. To stimulate the next zones, successively larger balls are dropped into respective successively larger seats D2, D3 near the successively higher formation zones causing end caps in intervals 132B, 132A to shear, blocking flow below the respective interval, allowing the in situ channelization treatment fluid, the energized in situ channelization treatment fluid, the pad substage fluid, the flush substage fluid, or another treatment fluid, to be directed through the ports 122 in the respective ported interval.

FIG. 8B operates in a similar manner except instead of using end caps, each port 140 is initially covered by a port blocking sleeve 142. Each port blocking sleeve 142 includes a recess 144 such that when the sliding sleeve 146 engages it, dogs 148 on the sliding sleeve 146 spring outwardly into the respective recess 144 allowing the sliding sleeve 146 to lock with the port blocking sleeve 142 and pull it downwardly to uncover the ports. As shown, there can be a series of port blocking sleeves 142 within the same zone each of which can be moved by the sliding sleeve 146. The remainder of this embodiment is identical to the previously described embodiment. That is, the ball/sleeve interface creates a barrier below the ports to direct a treatment fluid into a formation of interest. Packers isolate the formation above and below the ports, and after a treatment has been performed a larger ball can be dropped into a large seat near a next higher formation zone.

In some embodiments, in reference to FIGS. 9-22, an untethered and/or autonomous object may be used in the in situ channelization treatment fluid, the energized in situ channelization treatment fluid, the pad substage fluid, the flush substage fluid, or another treatment fluid, to operate the downhole completion staging system. In general, systems and techniques are disclosed herein for purposes of deploying an untethered object into a well and using an autonomous operation of the object to perform a downhole operation. In this context, an "untethered object" refers to an object that travels at least some distance in a well passageway without having its travel controlled via a surface mechanism, e.g., without being attached to a conveyance mechanism such as a slickline, wireline, coiled tubing string, and so forth, or being attached to a wireline solely to relay information from the tool to the surface; whereas an "autonomous object" refers to an object that automatically performs a downhole operation in response to an external stimulus in its immediate environment. As specific examples, the untethered object may be a dart, a ball or a bar. However, the untethered object may take on different forms, in accordance with further implementations. In accordance with some implementations, the untethered and/or autonomous object may be pumped into the well (i.e., pushed into the well with fluid), although pumping may not be employed to move the object in the well, in accordance with further implementations. In each of the specific embodiments disclosed herein unless otherwise specified, any of the untethered objects may be optionally autonomous and any of the autonomous objects may be optionally untethered. In accordance with further implementations, the untethered and/or autonomous object may be connected to a wireline to relay information from the tool to surface.

In general, the untethered and/or autonomous object may be used to perform a downhole operation that may or may not involve actuation of a downhole tool As just a few examples, the downhole operation may be a stimulation operation (a fracturing operation or an acidizing operation as examples); an operation performed by a downhole tool (the operation of a downhole valve, the operation of a single shot tool, or the operation of a perforating gun, as examples); the formation of a downhole obstruction; or the diversion of fluid (the diversion of fracturing fluid into a surrounding formation, for example). Moreover, in accordance with example implementations, a single untethered object may be used to perform multiple downhole operations in multiple zones, or stages, of the well, as further disclosed herein.

In accordance with example implementations, the untethered and/or autonomous object is deployed in a passageway (a tubing string passageway, for example) of the wellbore, autonomously senses its position as it travels in the passageway, and upon reaching a given targeted downhole position, autonomously operates to initiate a downhole operation. The untethered and/or autonomous object is initially radially contracted when the object is deployed into the passageway. The object monitors its position as the object travels in the passageway, and upon determining that it has reached a predetermined location in the well, the object radially expands. The increased cross-section of the object due to its radial expansion may be used to effect any of a number of downhole operations, such as shifting a valve, forming a fluid obstruction, actuating a tool, and so forth. Moreover, because the object remains radially contracted before reaching the predetermined location, the object may pass through downhole restrictions (valve seats, for example) that may otherwise "catch" the object, thereby allowing the object to be used in, for example, multiple stage applications in which the object is used in conjunction with seats of the same size so that the object selects which seat catches the object.

In general, the untethered and/or autonomous object is constructed to sense its downhole position as it travels in the well and autonomously respond based on this sensing. As disclosed herein, the untethered and/or autonomous object may sense its position based on features of the string, wellbore, casing, liner, markers, formation characteristics, and so forth, depending on the particular implementation. As a more specific example, for purposes of sensing its downhole location, the untethered and/or autonomous object may be constructed to, during its travel, sense specific points in the well, called "markers" herein. Moreover, as disclosed herein, the untethered and/or autonomous object may be constructed to detect the markers by sensing a property of the environment surrounding the object (a physical property of the string or formation, as examples). The markers may be dedicated tags or materials installed in the well for location sensing by the object or may be formed from features (sleeve valves, casing valves, casing collars, and so forth) of the well, which are primarily associated with downhole functions, other than location sensing. Moreover, as disclosed herein, in accordance with example implementations, the untethered and/or autonomous object may be constructed to sense its location in other and/or different ways that do not involve sensing a physical property of its environment, such as, for example, sensing a pressure for purposes of identifying valves or other downhole features that the object traverses during its travel.

In some embodiments, the use of the untethered and/or autonomous object in the in situ channelization treatment fluid, or in the energized in situ channelization treatment fluid, can decrease the volume of a terminal flush substage used to clean the wellbore of particles prior to initiation of fracturing a successive wellbore treatment stage, or even eliminate overflushing altogether. In some embodiments, the volume of the flush substage is less than a volume of the flowpath in the wellbore to the stage just treated, or substantially less. In some embodiments, the reduced flush substage volume is facilitated by the placement and/or formation of proppant clusters near the wellbore, in contrast to the conventional treatments, e.g., slickwater, where the proppant may screen out and thereby reduce near-wellbore permeability of the propped fracture, or where an overflush may push the proppant deeply into the fracture and thereby reduce the width of the near-wellbore unpropped or poorly propped fracture and thus reduce fracture conductivity, which can impair hydrocarbon production.

Typically in the art the skilled person may underestimate the near wellbore connection and its effect on conductivity, and thus ultimately production. The common practice in the art is to perforate 4-6 clusters, and push a slickwater laden fluid at fracture pressure to create fracture; it is estimated that 30 to 60% of these perforations do not produce due to for example screen out, geological constraint, etc., and thus for every 100 perforations in a wellbore, commonly only 30 to 70 of the conventional perforations are useful for production. According to embodiments of the instant disclosure herein, the untethered and/or autonomous object may be used to open, for example, 100 sleeves in a wellbore and a large proportion, such as all or almost all of these would be efficient, obviously leading to higher production. In some embodiments herein according to the instant disclosure, there is a breakthrough in terms of efficiency, e.g., more than 70% of the wellbore treatment stages are productive, for example 70-95% of the wellbore treatment stages are productive, or more than 75% of the wellbore treatment stages are productive, or more than 80% of the wellbore treatment stages are productive, or more than 85% of the wellbore treatment stages are productive, or more than 90% of the wellbore treatment stages are productive, or more than 95% of the wellbore treatment stages are productive, or more than 98% of the wellbore treatment stages are productive, or more than 99% of the wellbore treatment stages are productive, or substantially all of the wellbore treatment stages are productive.

According to some embodiments herein, relatively high conductivity channels are formed at least similar to the channels formed using the HiWAY® fracturing technology based on pulsed treatment fluid substages. In some instances, a multistage environment may be a difficult host for the types of pulses employed in the HiWAY® fracturing technology. For example, in some embodiments herein, the treatment fluid may comprise a generally homogeneous slurry of continuous proppant loading, and the proppant clusters are formed in the formation in situ in a generally uniformly distribution; such continuous proppant loading may facilitate the use of a multistage completion tool, as opposed to the employment of a pulsed treatment fluid pumping sequence which may be more challenging for multistage completions. According to some embodiments herein, in addition to the efficiency of the proppant clusters in the fractures, with both the multistage technique and in situ channelization, there may be relatively little or no overflushing required. This is a contrast with the conventional completion operations that are done with an overflushing of at least the volume of the wellbore, which may dilute the proppant concentration, disrupt the near wellbore integrity and in the case of gelled fluid, may modify the general chemical equilibrium. According to some embodiments herein, the in situ channelization treatment fluid is pumped into the fracture and then flowed back after the viscosity break occurs. Thus, both the production efficiency in terms of producing treatment stages as well as the conductivity may be beneficial.

Figure 9:
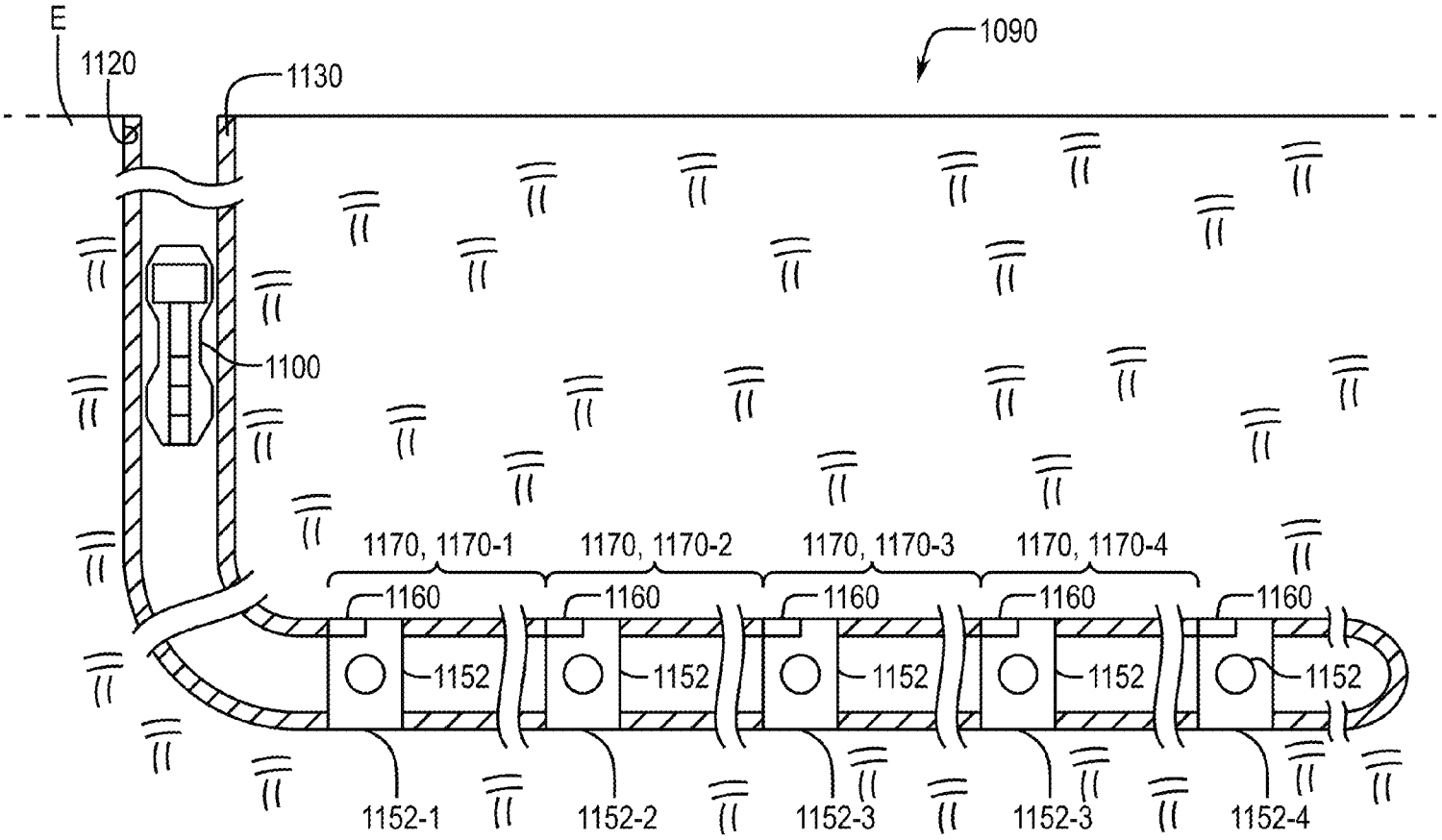
FIG. 9 is a schematic diagram of a multiple stage well according to an example implementation.

Referring to FIG. 9, as a more specific example, in accordance with some implementations, a multiple stage well 1090 includes a wellbore 1120, which traverses one or more formations, e.g., hydrocarbon bearing formations. As a more specific example, the wellbore 1120 may be lined, or supported, by a tubing string 1130, as depicted in FIG. 9. The tubing string 1130 may be cemented to the wellbore 1120 (such wellbores typically are referred to as "cased hole" wellbores); or the tubing string 1130 may be secured to the formation by packers (such wellbores typically are referred to as "open hole" wellbores). In general, the wellbore 1120 extends through one or multiple zones, or stages 1170 (four stages 1170-1, 1170-2, 1170-3 and 1170-4, being depicted as examples in FIG. 9) of the well 1090.

It is noted that although FIG. 9 depicts a laterally extending wellbore 1120, the systems and techniques that are disclosed herein may likewise be applied to vertical wellbores. In accordance with example implementations, the well 1090 may contain multiple wellbores, which contain tubing strings that are similar to the illustrated tubing string 1130. Moreover, depending on the particular implementation, the well 1090 may be an injection well or a production well. Thus, many variations are contemplated, which are within the scope of the appended claims.

In general, the downhole operations may be multiple stage operations that may be sequentially performed in the stages 1170 in a particular direction, e.g., in a direction from the toe end of the wellbore 1120 to the heel end of the wellbore 1120, or may be performed in no particular direction or sequence, depending on the implementation. Fluid communication with the surrounding reservoir may also be enhanced in one or more of the stages 1170 through, for example, abrasive jetting operations, perforating operations, and so forth.

In accordance with example implementations, the well 1090 of FIG. 9 includes downhole tools 1152 (tools 1152-1, 1152-2, 1152-3 and 1152-4, being depicted in FIG. 9 as examples) that are located in the respective stages 1170. The tool 1152 may be any of a variety of downhole tools, such as a valve, e.g. a circulation valve, a casing valve, a sleeve valve, and so forth; a seat assembly; a check valve; a plug assembly; and so forth, depending on the particular implementation. Moreover, the tool 1152 may be different tools, such as a mixture of casing valves, plug assemblies, check valves, and so forth, for example.

A given tool 1152 may be selectively actuated by deploying an untethered and/or autonomous object through the central passageway of the tubing string 1130 in or with the in situ channelization treatment fluid, the energized in situ channelization treatment fluid, the pad substage fluid, the flush substage fluid, or another treatment fluid. In general, the untethered and/or autonomous object has a radially contracted state to permit the object to pass relatively freely through the central passageway of the tubing string 1130 (and thus, through tools of the string 1130), and the object has a radially expanded state, which causes the object to land in, or, be "caught" by, a selected one of the tools 1152 or otherwise secured at a selected downhole location, in general, for purposes of performing a given downhole operation. For example, a given downhole tool 1152 may catch the untethered and/or autonomous object for purposes of forming a downhole obstruction to divert fluid, such as to divert fluid in a fracturing or other stimulation operation, for example; pressurize a given stage 1170; shift a sleeve of the tool 1152; actuate the tool 1152; install a check valve or other part of the object in the tool 1152; and so forth, depending on the particular implementation.

For the specific example of FIG. 9, the untethered object is a dart 1100, which, as depicted in FIG. 9, may be deployed (as an example) from the Earth surface E into the tubing string 1130 with the in situ channelization treatment fluid, the energized in situ channelization treatment fluid, the pad substage fluid, the flush substage fluid, or another treatment fluid, and propagate along the central passageway of the string 1130 until the dart 1100 senses proximity of the targeted tool 1152, as further disclosed herein, radially expands and engages the tool 1152. It is noted that the dart 1100 may be deployed from a location other than the Earth surface E, in accordance with further implementations. For example, the dart 1100 may be released by a downhole tool. As another example, the dart 1100 may be run downhole on a conveyance mechanism and then released downhole to travel further downhole untethered.

Although examples are disclosed herein in which the dart 1100 is constructed to radially expand at the appropriate time so that a tool 1152 of the string 1130 catches the dart 1100, in accordance with other implementations disclosed herein, the dart 1100 may be constructed to secure itself to an arbitrary position of the string 1130, which is not part of a tool 1152. Thus, many variations are contemplated, which are within the scope of the appended claims.

For the example that is depicted in FIG. 9, the dart 1100 is deployed in the tubing string 1130 from the Earth surface E for purposes of engaging one of the tool 1152 (i.e., for purposes of engaging a "targeted tool 1152"). The dart 1100 autonomously senses its downhole position, remains radially contracted to pass through tool(s) 152 (if any) uphole of the targeted tool 1152, and radially expands before or upon reaching the targeted tool 1152. In accordance with some implementations, the dart 1100 senses its downhole position by sensing the presence of markers 1160 which may be distributed along the tubing string 1130.

For the specific example of FIG. 9, each stage 1170 contains a marker 1160, and each marker 1160 is embedded in a different tool 1152. The marker 1160 may be a specific material, a specific downhole feature, a specific physical property, a radio frequency (RF) identification (RFID) tag, and so forth, depending on the particular implementation.

It is noted that each stage 1170 may contain multiple markers 1160; a given stage 1170 may not contain any markers 1160; the markers 1160 may be deployed along the tubing string 1130 at positions that do not coincide with given tools 1152; the markers 1160 may not be evenly/regularly distributed as depicted in FIG. 9; and so forth, depending on the particular implementation. Moreover, although FIG. 9 depicts the markers 1160 as being deployed in the tools 1152, the markers 1160 may be deployed at defined distances with respect to the tools 1152, depending on the particular implementation. For example, the markers 1160 may be deployed between or at intermediate positions between respective tools 1152, in accordance with further implementations. Thus, many variations are contemplated, which are within the scope of the appended claims.

In accordance with an example implementation, a given marker 1160 may be a magnetic material-based marker, which may be formed, for example, by a ferromagnetic material that is embedded in or attached to the tubing string 1130, embedded in or attached to a given tool housing, and so forth. By sensing the markers 1160, the dart 1100 may determine its downhole position and selectively radially expand accordingly. As further disclosed herein, in accordance with an example implementation, the dart 1100 may maintain a count of detected markers. In this manner, the dart 1100 may sense and log when the dart 1100 passes a marker 1160 such that the dart 1100 may determine its downhole position based on the marker count.

Thus, the dart 1100 may increment (as an example) a marker counter (an electronics-based counter, for example) as the dart 1100 traverses the markers 1160 in its travel through the tubing string 1130; and when the dart 1100 determines that a given number of markers 1160 have been detected (via a threshold count that is programmed into the dart 1100, for example), the dart 1100 radially expands.

For example, the dart 1100 may be launched into the well 1090 for purposes of being caught in the tool 1152-3. Therefore, given the example arrangement of FIG. 1, the dart 1100 may be programmed at the Earth surface E to count two markers 1160 (i.e., the markers 1160 of the tools 1152-1 and 1152-2) before radially expanding. The dart 1100 passes through the tools 1152-1 and 1152-2 in its radially contracted state; increments its marker counter twice due to the detection of the markers 152-1 and 1152-2; and in response to its marker counter indicating a "2," the dart 1100 radially expands so that the dart 1100 has a cross-sectional size that causes the dart 1100 to be "caught" by the tool 1152-3.

Figure 10:
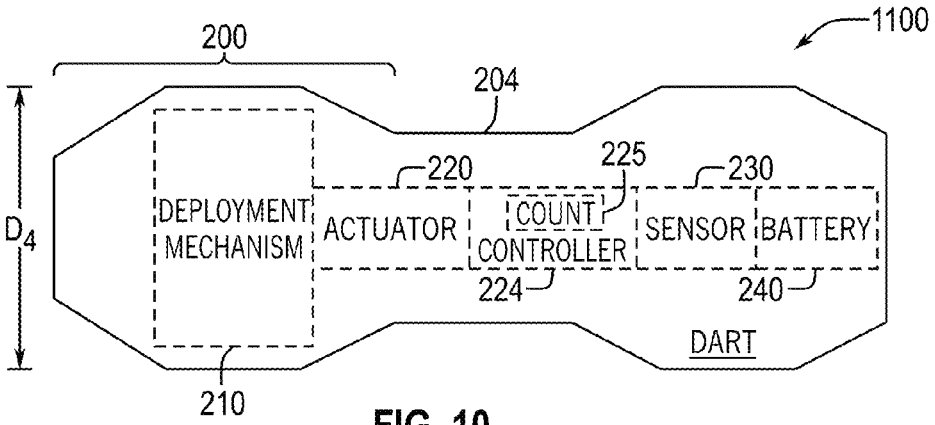
FIG. 10 is a schematic diagram of a dart in FIG. 9 in a radially contracted state according to an example implementation.
Figure 11:
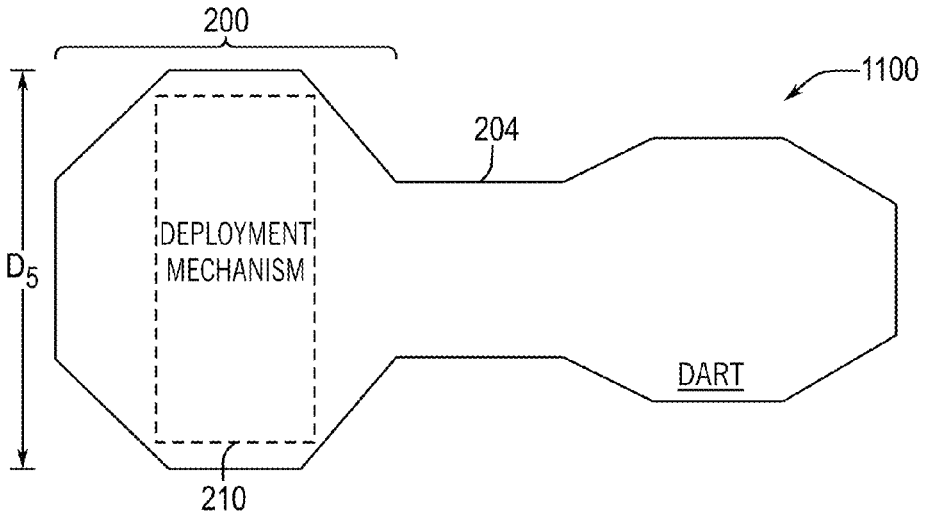
FIG. 11 is a schematic diagram of the dart in FIGS. 9-10 in a radially expanded state according to an example implementation.

Referring to FIG. 10, in accordance with an example implementation, the dart 1100 includes a body 204 having a section 200, which is initially radially contracted to a cross-sectional diameter $D_4$ when the dart 1100 is first deployed in the well 1090, for example, with the in situ channelization treatment fluid, the energized in situ channelization treatment fluid, the pad substage fluid, the flush substage fluid, or another treatment fluid. The dart 1100 autonomously senses its downhole location and autonomously expands the section 200 to a radially larger cross-sectional diameter $D_5$ (as depicted in FIG. 11) for purposes of causing the next encountered tool 1152 to catch the dart 1100.

As depicted in FIG. 10, in accordance with an example implementation, the dart 1100 include a controller 224 (a microcontroller, microprocessor, field programmable gate array (FPGA), or central processing unit (CPU), as examples), which receives feedback as to the dart's position and generates the appropriate signal(s) to control the radial expansion of the dart 1100. As depicted in FIG. 10, the controller 224 may maintain a count 225 of the detected markers, which may be stored in a memory (a volatile or a non-volatile memory, depending on the implementation) of the dart 1100.

In this manner, in accordance with an example implementation, the sensor 230 provides one or more signals that indicate a physical property of the dart's environment (a magnetic permeability of the tubing string 1130, a radioactivity emission of the surrounding formation, and so forth); the controller 224 use the signal(s) to determine a location of the dart 1100; and the controller 224 correspondingly activates an actuator 220 to expand a deployment mechanism 210 of the dart 1100 at the appropriate time to expand the cross-sectional dimension of the section 200 from the $D_4$ diameter to the $D_5$ diameter. As depicted in FIG. 10, among its other components, the dart 1100 may have a stored energy source, such as a battery 240, and the dart 1100 may have an interface (a wireless interface, for example), for purposes of programming the dart 1100 with a threshold marker count before the dart 1100 is deployed in the well 1090.

The dart 1100 may, in accordance with example implementations, count specific markers, while ignoring other markers. In this manner, another dart may be subsequently launched into the tubing string 1130 to count the previously-ignored markers (or count all of the markers, including the ignored markers, as another example) in a subsequent operation, such as a remedial action operation, a fracturing operation, and so forth. In this manner, using such an approach, specific portions of the well 1090 may be selectively treated at different times. In accordance with some example implementations, the tubing string 1130 may have more tools 1152 (see FIG. 9), such as sleeve valves (as an example), than are needed for current downhole operations, for purposes of allowing future refracturing or remedial operations to be performed.

In accordance with example implementations, the sensor 230 senses a magnetic field. In this manner, the tubing string 1130 may contain embedded magnets, and sensor 230 may be an active or passive magnetic field sensor that provides one or more signals, which the controller 224 interprets to detect the magnets. However, in accordance with further implementations, the sensor 230 may sense an electromagnetic coupling path for purposes of allowing the dart 1100 to electromagnetic coupling changes due to changing geometrical features of the string 1130 (thicker metallic sections due to tools versus thinner metallic sections for regions of the string 1130 where tools are not located, for example) that are not attributable to magnets. In other example implementations, the sensor 230 may be a gamma ray sensor that senses a radioactivity. Moreover, the sensed radioactivity may be the radioactivity of the surrounding formation. In this manner, a gamma ray log may be used to program a corresponding location radioactivity-based map into a memory of the dart 1100.

Figure 12:
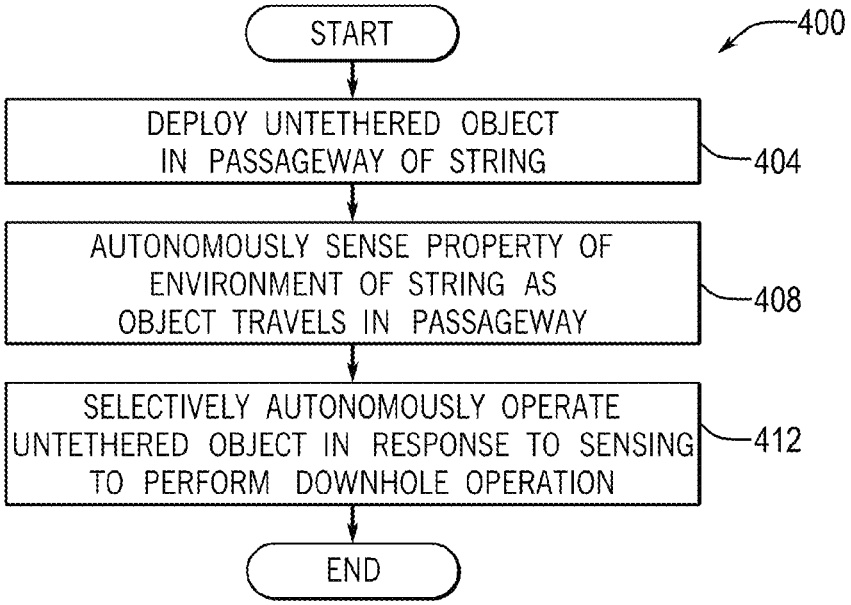
FIGS. 12, 14B and 22 are flow diagrams depicting techniques to autonomously operate an object in a well to perform an operation in the well according to example implementations.

Regardless of the particular sensor 230 or sensors 230 used by the dart 1100 to sense its downhole position, in general, the dart 1100 may perform a technique 400 that is depicted in FIG. 12. Referring to FIG. 12, in accordance with example implementations, the technique 400 includes deploying (block 404) an untethered object, such as a dart, through a passageway of a string with the in situ channelization treatment fluid, the energized in situ channelization treatment fluid, the pad substage fluid, the flush substage fluid, or another treatment fluid, and autonomously sensing (block 408) a property of an environment of the string as the object travels in the passageway of the string. The technique 400 includes autonomously controlling the object to perform a downhole function, which may include, for example, selectively radially expanding (block 412) the untethered object in response to the sensing.

Figure 13:
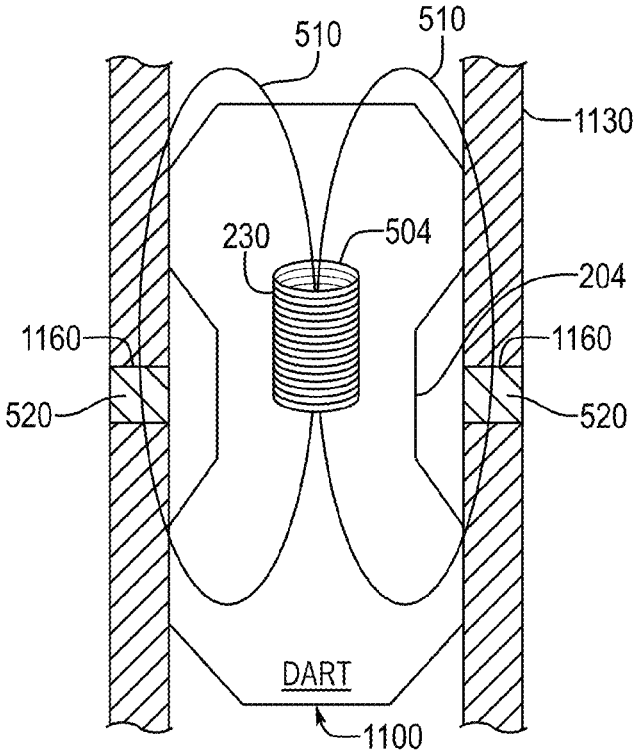
FIG. 13 is a schematic diagram of a dart illustrating a magnetic field sensor of the dart of FIG. 8 according to an example implementation.

Referring to FIG. 13 in conjunction with FIG. 10, in accordance with an example implementation, the sensor 230 of the dart 1100 may include a coil 504 for purposes of sensing a magnetic field. In this manner, the coil 504 may be formed from an electrical conductor that has multiple windings about a central opening. When the dart passes in proximity to a ferromagnetic material 520, such as a magnetic marker 1160 that contains the material 520, magnetic flux lines 510 of the material 520 pass through the coil 504. Thus, the magnetic field that is sensed by the coil 504 changes in strength due to the motion of the dart 1100 (i.e., the influence of the material 520 on the sensed magnetic field changes as the dart 1100 approaches the material 520, coincides in location with the material 520 and then moves past the material 520). The changing magnetic field, in turn, induces a current in the coil 504. The controller 224 (see FIG. 10) may therefore monitor the voltage across the coil 504 and/or the current in the coil 504 for purposes of detecting a given marker 1160. The coil 504 may or may not be pre-energized with a current (i.e., the coil 504 may passively or actively sense the magnetic field), depending on the particular implementation.

It is noted that FIGS. 10 and 13 depict a simplified view of the sensor 230 and controller 224, as the skilled artisan would appreciate that numerous other components may be used, such as an analog-to-digital converter (ADC) to convert an analog signal from the coil 504 into a corresponding digital value, an analog amplifier, and so forth, depending on the particular implementation.

In accordance with example implementations, the dart 1100 may sense a pressure to detect features of the tubing string 1130 for purposes of determining the location/downhole position of the dart 1100. For example, referring to FIG. 14A, in accordance with example implementations, the dart 1100 includes a differential pressure sensor 620 that senses a pressure in a passageway 610 that is in communication with a region 660 uphole from the dart 1100 and a passageway 614 that is in communication with a region 670 downhole of the dart 1100. Due to this arrangement, the partial fluid seal/obstruction that is introduced by the dart 1100 in its radially contracted state creates a pressure difference between the upstream and downstream ends of the dart 1100 when the dart 1100 passes through a valve in the in situ channelization treatment fluid, the energized in situ channelization treatment fluid, the pad substage fluid, the flush substage fluid, or another treatment fluid.

Figure 14A:
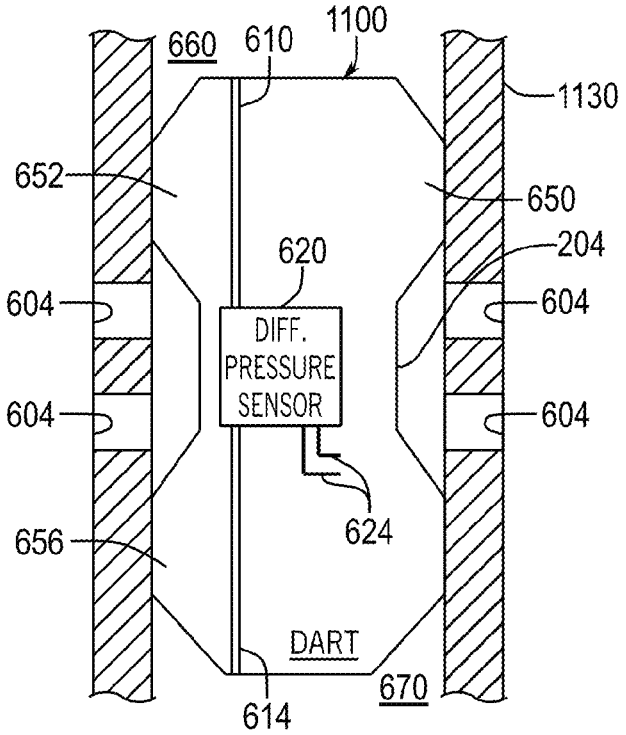
FIG. 14A is a schematic diagram illustrating a differential pressure sensor of the dart in FIG. 9 according to an example implementation.

For example, as shown in FIG. 14A, a given valve may contain radial ports 604. Therefore, for this example, the differential pressure sensor 620 may sense a pressure difference as the dart 1100 travels in the in situ channelization treatment fluid, the energized in situ channelization treatment fluid, the pad substage fluid, the flush substage fluid, or another treatment fluid, due to a lower pressure below the dart 1100 as compared to above the dart 1100 due to a difference in pressure between the hydrostatic fluid above the dart 1100 and the reduced pressure (due to the ports 604) below the dart 1100. As depicted in FIG. 14A, the differential pressure sensor 620 may contain terminals 624 that, for example, electrically indicate the sensed differential pressure (provide a voltage representing the sensed pressure, for example), which may be communicated to the controller 224 (see FIG. 10). For these example implementations, valves of the tubing string 1130 are effectively used as markers for purposes of allowing the dart 1100 to sense its position along the tubing string 1130.

Figure 14B:
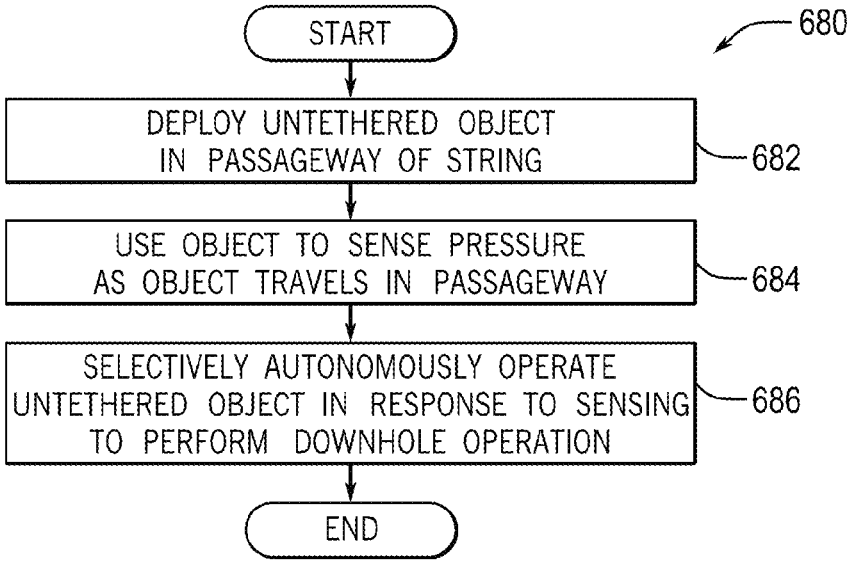

Therefore, in accordance with example implementations, a technique 680 that is depicted in FIG. 14B may be used to autonomously operate the dart 1100. Pursuant to the technique 680, an untethered object is deployed (block 682) in a passageway of the string with the in situ channelization treatment fluid, the energized in situ channelization treatment fluid, the pad substage fluid, the flush substage fluid, or another treatment fluid; and the object is used (block 684) to sense pressure as the object travels in a passageway of the string. The technique 680 includes selectively autonomously operating (block 686) the untethered object in response to the sensing to perform a downhole operation.

In accordance with some implementations, the dart 1100 may sense multiple indicators of its position as the dart 1100 travels in the string. For example, in accordance with example implementations, the dart 1100 may sense both a physical property and another downhole position indicator, such as a pressure (or another property), for purposes of determining its downhole position. Moreover, in accordance with some implementations, the markers 1160 (see FIG. 9) may have alternating polarities, which may be another position indicator that the dart 1100 uses to assess/corroborate its downhole position. In this regard, magnetic-based markers 1160, in accordance with an example implementation, may be distributed and oriented in a fashion such that the polarities of adjacent magnets alternate. Thus, for example, one marker 1160 may have its north pole uphole from its south pole, whereas the next marker 1160 may have its south pole uphole from its north pole; and the next the marker 1160-3 may have its north pole uphole from its south pole; and so forth. The dart 1100 may use the knowledge of the alternating polarities as feedback to verify/assess its downhole position.

Figure 15:
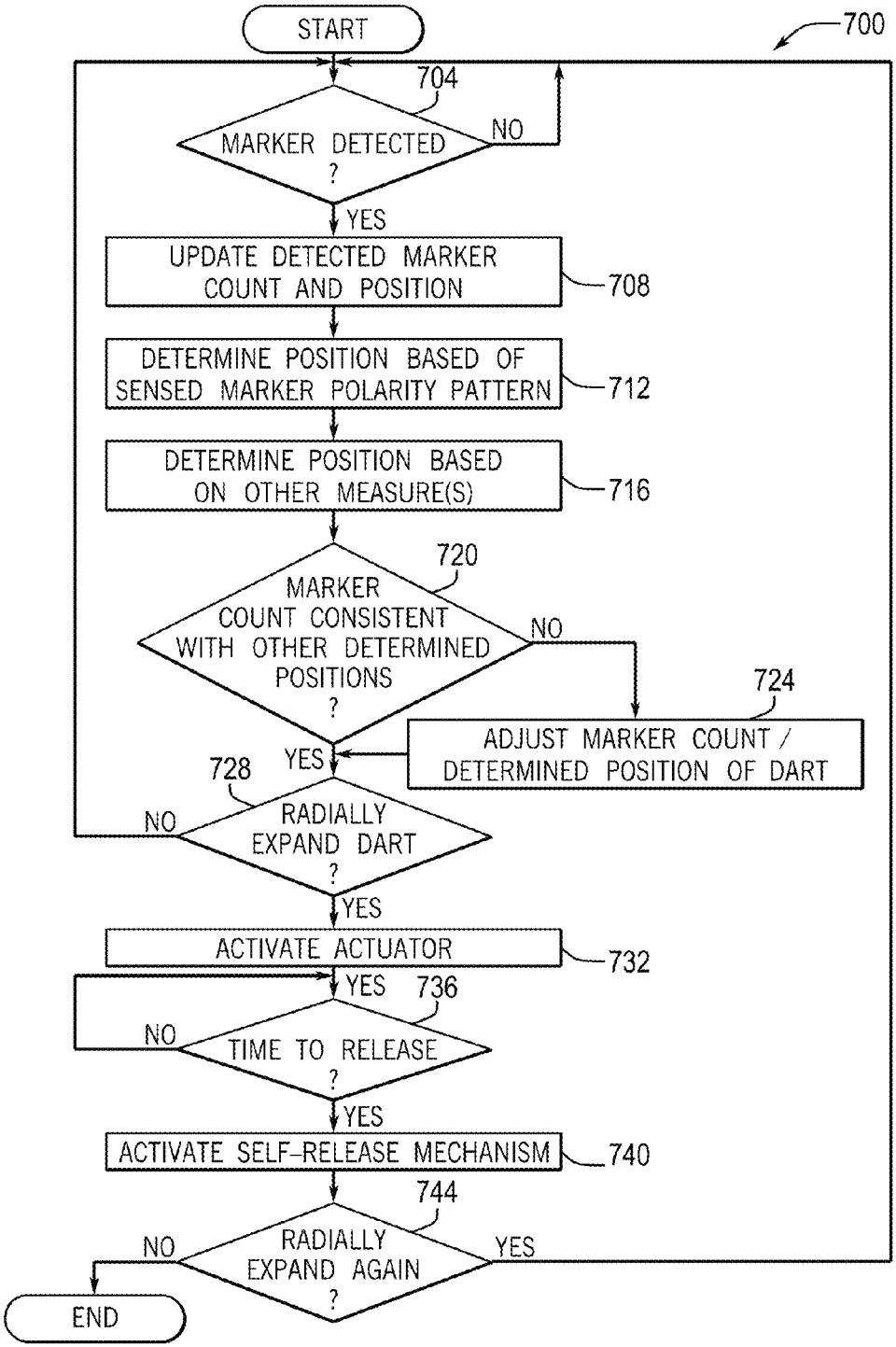
FIG. 15 is a flow diagram depicting a technique to autonomously operate a dart in a well to perform an operation in the well according to an example implementation.

Thus, referring to FIG. 15, in accordance with an example implementation, a technique 700 for autonomously operating an untethered object in a well, such as the dart 1100, includes determining (decision block 704) whether a marker has been detected. If so, the dart 1100 updates a detected marker count and updates its position, pursuant to block 708. The dart 1100 further determines (block 712) its position based on a sensed marker polarity pattern, and the dart 1100 may determine (block 716) its position based on one or more other measures (a sensed pressure, for example). If the dart 1100 determines (decision block 720) that the marker count is inconsistent with the other determined position(s), then the dart 1100 adjusts (block 724) the count/position. Next, the dart 1100 determines (decision block 728) whether the dart 1100 should radially expand the dart based on determined position. If not, control returns to decision block 704 for purposes of detecting the next marker.

If the dart 1100 determines (decision block 728) that its position triggers its radially expansion, then the dart 1100 activates (block 732) its actuator for purposes of causing the dart 1100 to radially expand to at least temporarily secure the dart 1100 to a given location in the tubing string 1130. At this location, the dart 1100 may or may not be used to perform a downhole function, depending on the particular implementation.

In accordance with example implementations, the dart 1100 may contain a self-release mechanism. In this regard, in accordance with example implementations, the technique 700 includes the dart 1100 determining (decision block 736) whether it is time to release the dart 1100, and if so, the dart 1100 activates (block 740) its self-release mechanism. In this manner, in accordance with example implementations, activation of the self-release mechanism causes the dart's deployment mechanism 210 (see FIGS. 10 and 11) to radially contract to allow the dart 1100 to travel further into the tubing string 1130. Subsequently, after activating the self-release mechanism, the dart 1100 may determine (decision block 744) whether the dart 1100 is to expand again or whether the dart has reached its final position. In this manner, a single dart 1100 may be used to perform multiple downhole operations in potentially multiple stages, in accordance with example implementations. If the dart 1100 is to expand again (decision block 744), then control returns to decision block 704.

Figure 16A:
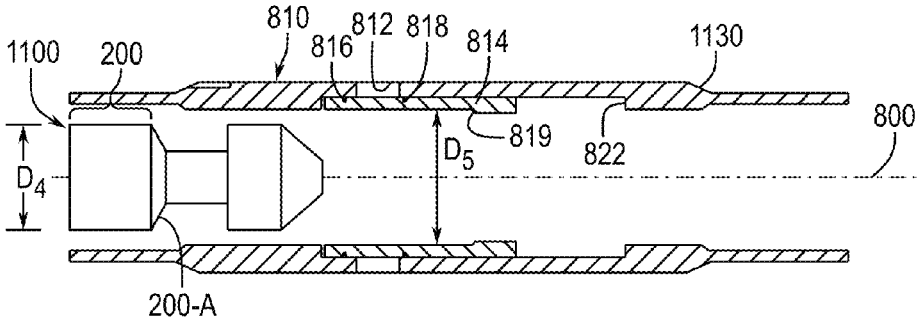
FIGS. 16A and 16B are cross-sectional views illustrating use of the dart to operate a valve according to an example implementation.
Figure 16B:
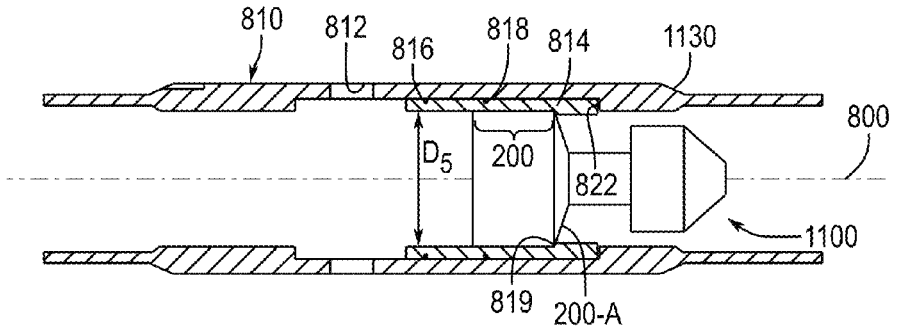

As a more specific example, FIGS. 16A and 16B depict engagement of the dart 1100 with a valve assembly 810 of the tubing string 1130. As an example, the valve assembly 810 may be a casing valve assembly, which is run into the well 1090 closed and which may be opened by the dart 1100 for purposes of opening fluid communication between the central passageway of the string 1130 and the surrounding formation. For example, communication with the surrounding formation may be established/opened through the valve assembly 810 for purposes of performing a fracturing operation.

In general, the valve assembly 810 includes radial ports 812 that are formed in a housing of the valve assembly 810, which is constructed to be part of the tubing string 1130 and generally circumscribe a longitudinal axis 800 of the assembly 810. The valve assembly 810 includes a radial pocket 822 to receive a corresponding sleeve 814 that may be moved along the longitudinal axis 800 for purposes of opening and closing fluid communication through the radial ports 812. In this manner, as depicted in FIG. 16A, in its closed state, the sleeve 814 blocks fluid communication between the central passageway of the valve assembly 810 and the radial ports 812. In this regard, the sleeve 814 closes off communication due to seals 816 and 818 (O-ring seals, for example) that are disposed between the sleeve 814 and the surrounding housing of the valve assembly 810.

As depicted in FIG. 16A, in general, the sleeve 814 has an inner diameter $D_5$, which generally matches the expanded $D_5$ diameter of the dart 1100. Thus, referring to FIG. 16B, when the dart 1100 is in proximity to the sleeve 814, the dart 1100 radially expands the section 200 to close to or at the diameter $D_4$ to cause a shoulder 200-A of the dart 1100 to engage a shoulder 819 of the sleeve 814 so that the dart 1100 becomes lodged, or caught in the sleeve 814, as depicted in FIG. 16B. Therefore, upon application of fluid pressure to the dart 1100, the dart 1100 translates in the in situ channelization treatment fluid, the energized in situ channelization treatment fluid, the pad substage fluid, the flush substage fluid, or another treatment fluid, along the longitudinal axis 800 to shift open the sleeve 814 to expose the radial ports 812 for purposes of transitioning the valve assembly 810 to the open state and allowing fluid communication through the radial ports 812.

In general, the valve assembly 810 depicted in FIGS. 16A and 16B is constructed to catch the dart 1100 (assuming that the dart 1100 expands before reaching the valve assembly 810) and subsequently retain the dart 1100 until (and if) the dart 1100 engages a self-release mechanism.

Figure 17A:
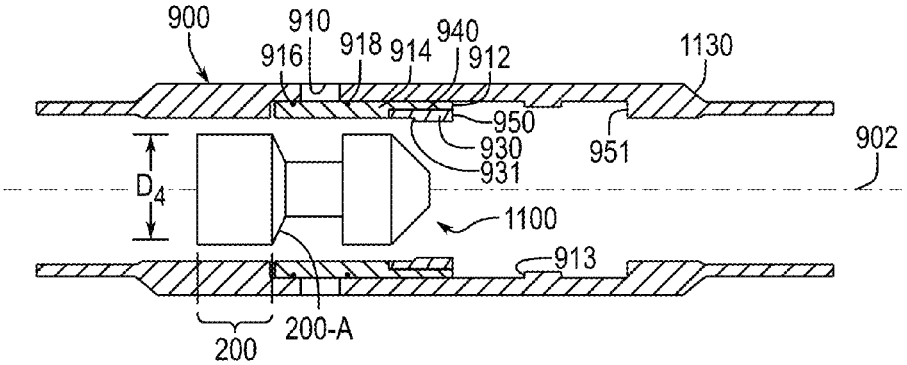
FIGS. 17A and 17B are cross-sectional views illustrating use of the dart to operate a valve that has a mechanism to release the dart according to an example implementation.
Figure 17B:
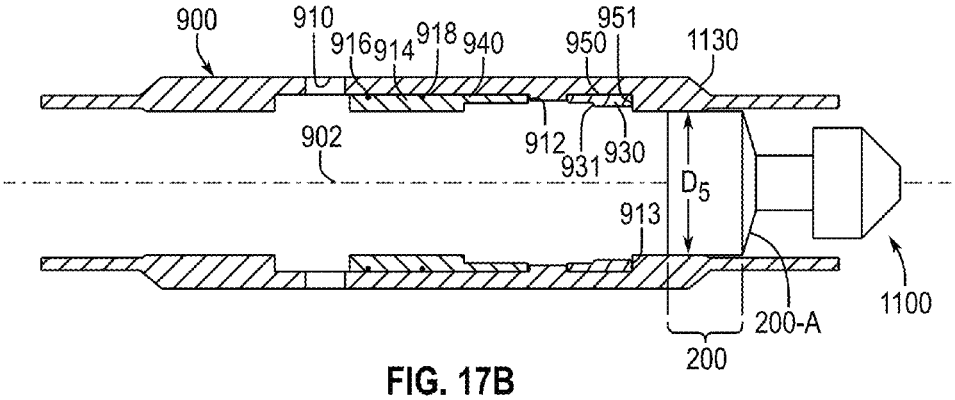

In accordance with some implementations, the valve assembly may contain a self-release mechanism, which is constructed to release the dart 1100 after the dart 1100 actuates the valve assembly. As an example, FIGS. 17A and 17B depict a valve assembly 900 that also includes radial ports 910 and a sleeve 914 for purposes of selectively opening and closing communication through the radial ports 910. In general, the sleeve 914 resides inside a radially recessed pocket 912 of the housing of the valve assembly 900, and seals 916 and 918 provide fluid isolation between the sleeve 914 and the housing when the valve assembly 900 is in its closed state. Referring to FIG. 17A, when the valve assembly 910 is in its closed state, a collet 930 of the assembly 910 is attached to and disposed inside a corresponding recessed pocket 940 of the sleeve 914 for purposes of catching the dart 1100 (assuming that the dart 1100 is in its expanded D2 diameter state). Thus, as depicted in FIG. 17A, when entering the valve assembly 900, the section 200 of the dart 1100, when radially expanded, is sized to be captured inside the inner diameter of the collet 930 via the shoulder 200-A seating against a stop shoulder 913 of the pocket 912.

The securement of the section 200 of the dart 1100 to the collet 930, in turn, shifts the sleeve 914 to open the valve assembly 900. Moreover, further translation of the dart 1100 in the in situ channelization treatment fluid, the energized in situ channelization treatment fluid, the pad substage fluid, the flush substage fluid, or another treatment fluid, along the longitudinal axis 902 moves the collet 930 outside of the recessed pocket 940 of the sleeve 914 and into a corresponding recessed region 950 further downhole of the recessed region 912 where a stop shoulder 951 engages the collet 930. This state is depicted in FIG. 17B, which shows the collet 930 as being radially expanded inside the recess region 940. For this radially expanded state of the collet 930, the dart 1100 is released, and allowed to travel further downhole.

Thus, in accordance with some implementations, for purposes of actuating, or operating, multiple valve assemblies, the tubing string 1130 may contain a succession, or "stack," of one or more of the valve assemblies 900 (as depicted in FIGS. 17A and 17B) that have self-release mechanisms, with the very last valve assembly being a valve assembly, such as the valve assembly 800, which is constructed to retain the dart 1100.

Figure 18:
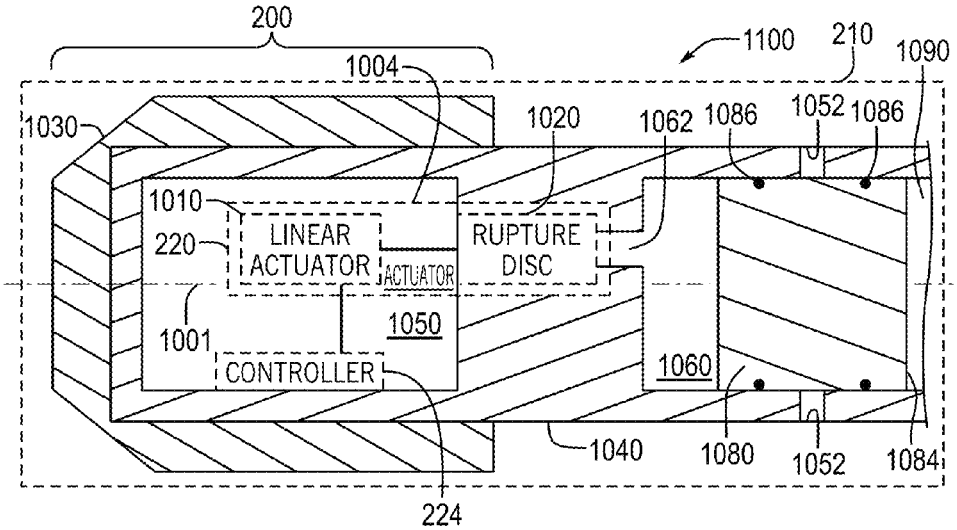
FIG. 18 is a schematic diagram of a deployment mechanism of the dart according to an example implementation.

Referring to FIG. 18, in accordance with example implementations, the deployment mechanism 210 of the dart 1100 may be formed from an atmospheric pressure chamber 1050 and a hydrostatic pressure chamber 1060. More specifically, in accordance with an example implementation, a mandrel 1080 resides inside the hydrostatic pressure chamber 1060 and controls the communication of hydrostatic pressure (received in a region 1090 of the dart 1100) and radial ports 1052. As depicted in FIG. 18, the mandrel 1080 is sealed to the inner surface of the housing of the dart via (O-rings 1086, for example). Due to the chamber 1050 initially exerting atmospheric pressure, the mandrel 1080 blocks fluid communication through the radial ports 1052.

As depicted in FIG. 18, the deployment mechanism 210 includes a deployment element 1030 that is expanded in response to fluid at hydrostatic pressure being communicated through the radial ports 1052. As examples, the deployment element 1030 may be an inflatable bladder, a packer that is compressed in response to the hydrostatic pressure, and so forth. Thus, many implementations are contemplated, which are within the scope of the appended claims.

For purposes of radially expanding the deployment element 1030, in accordance with an example implementation, the dart 1100 includes a valve, such as a rupture disc 1020, which controls fluid communication between the hydrostatic chamber 1060 and the atmospheric chamber 1050. In this regard, pressure inside the hydrostatic chamber 1060 may be derived by establishing communication with the chamber 1060 via one or more fluid communication ports with the region uphole of the dart 1100. The controller 224 selectively actuates the actuator 220 for purposes of rupturing the rupture disc 1020 to establish communication between the hydrostatic 1060 and atmospheric 1050 chambers for purposes of causing the mandrel 1080 to translate to a position to allow communication of hydrostatic pressure through the radial ports 1052 and to the deployment element 1030 for purposes of radially expanding the element 1030.

As an example, in accordance with some implementations, the actuator 220 may include a linear actuator 1020, which when activated by the controller 224 controls a linearly operable member to puncture the rupture disc 1020 for purposes of establishing communication between the atmospheric 1050 and hydrostatic 1060 chambers. In further implementations, the actuator 220 may include an exploding foil initiator (EFI) to activate and a propellant that is initiated by the EFI for purposes of puncturing the rupture disc 1020. Thus, many implementations are contemplated, which are within the scope of the appended claims.

In accordance with some example implementations, the self-release mechanism of the dart 1100 may be formed from a reservoir and a metering valve, where the metering valve serves as a timer. In this manner, in response to the dart radially expanding, a fluid begins flowing into a pressure relief chamber. For example, the metering valve may be constructed to communicate a metered fluid flow between the chambers 1050 and 1060 (see FIG. 18) for purposes of resetting the deployment element 1030 to a radially contracted state to allow the dart 1100 to travel further into the well 1090. As another example, in accordance with some implementations, one or more components of the dart, such as the deployment mechanism 1030 (FIG. 18) may be constructed of a dissolvable material, and the dart may release a solvent from a chamber at the time of its radial expansion to dissolve the mechanism 1030.

Figure 19:
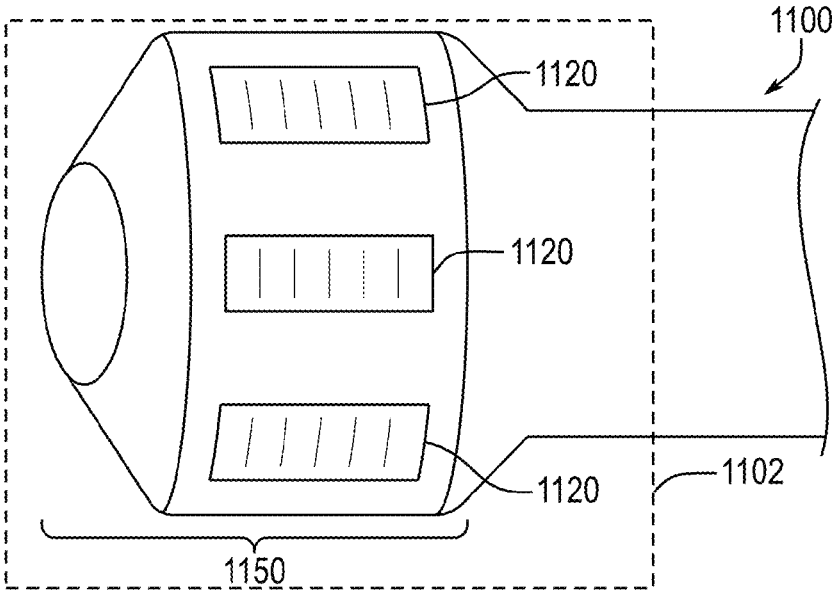
FIG. 19 is a perspective view of a deployment mechanism of a dart according to a further example implementation.

As yet another example, FIG. 19 depicts a portion of a dart 1100 in accordance with another example implementation. For this implementation, a deployment mechanism 1102 of the dart 1100 includes slips 1120, or hardened "teeth," which are designed to be radially expanded for purposes of gripping the wall of the tubing string 1130, without using a special seat or profile of the tubing string 1130 to catch the dart 1100. In this manner, the deployment mechanism 1102 may contains sleeves, or cones, to slide toward each other along the longitudinal axis of the dart to force the slips 1120 radially outwardly to engage the tubing string 1130 and stop the dart's travel in the in situ channelization treatment fluid, the energized in situ channelization treatment fluid, the pad substage fluid, the flush substage fluid, or another treatment fluid. Thus, many variations are contemplated, which are within the scope of the appended claims.

Figure 20:
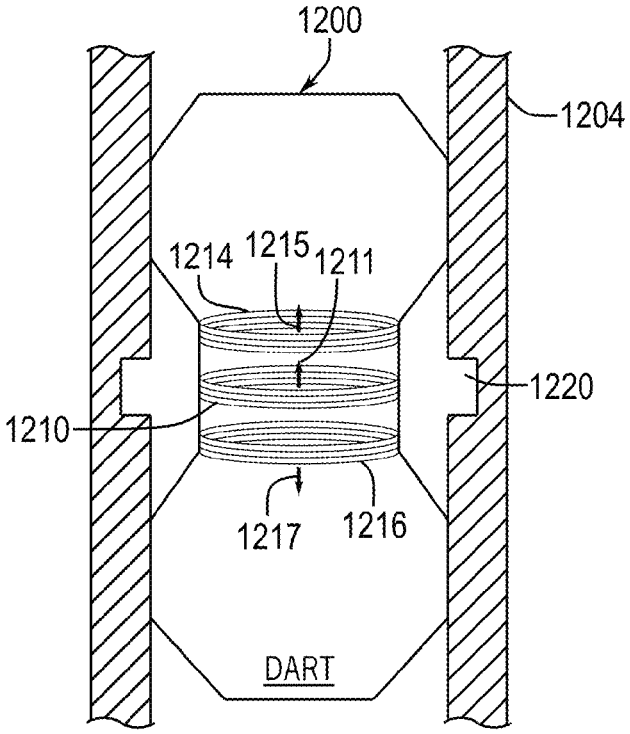
FIG. 20 is a schematic diagram of a dart illustrating an electromagnetic coupling sensor of the dart according to an example implementation.

Other variations are contemplated, which are within the scope of the appended claims. For example, FIG. 20 depicts a dart 1200 according to a further example implementation. In general, the dart 1200 includes an electromagnetic coupling sensor that is formed from two receiver coils 1214 and 1216, and a transmitter coil 1210 that resides between the receiver coils 1215 and 1216. As shown in FIG. 12, the receiver coils 1214 and 1216 have respective magnetic moments 1215 and 1217, respectively, which are opposite in direction. It is noted that the moments 1215 and 1217 that are depicted in FIG. 20 may be reversed, in accordance with further implementations. As also shown in FIG. 20, the transmitter 1210 has an associated magnetic moment 1211, which is pointed upwardly in FIG. 20, but may be pointed downwardly, in accordance with further implementations.

In general, the electromagnetic coupling sensor of the dart 1200 senses geometric changes in a tubing string 1204 in which the dart 1200 travels in the in situ channelization treatment fluid, the energized in situ channelization treatment fluid, the pad substage fluid, the flush substage fluid, or another treatment fluid. More specifically, in accordance with some implementations, the controller of the dart 1200 algebraically adds, or combines, the signals from the two receiver coils 1214 and 1216, such that when both receiver coils 1214 and 1216 have the same effective electromagnetic coupling the signals are the same, thereby resulting in a net zero voltage signal. However, when the electromagnetic coupling sensor passes by a geometrically varying feature of the tubing string 1204 (a geometric discontinuity or a geometric dimension change, such as a wall thickness change, for example), the signals provided by the two receiver coils 1214 and 1216 differ. This difference, in turn, produces a non-zero voltage signal, thereby indicating to the controller that a geometric feature change of the tubing string 1204 has been detected.

Such geometric variations may be used, in accordance with example implementations, for purposes of detecting certain geometric features of the tubing string 1204, such as, for example, sleeves or sleeve valves of the tubing string 1204. Thus, by detecting and possibly counting sleeves (or other tools or features), the dart 1200 may determine its downhole position and actuate its deployment mechanism accordingly.

Figure 21:
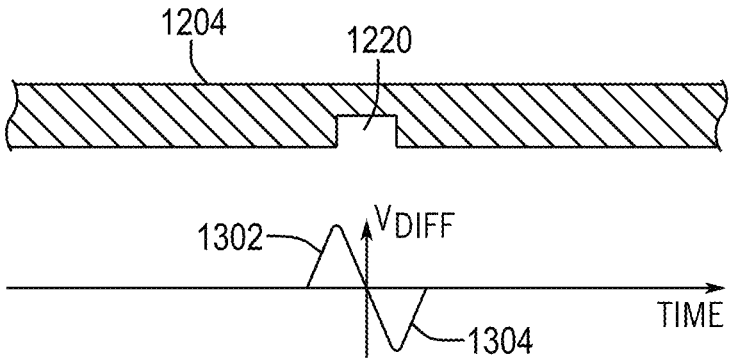
FIG. 21 is an illustration of a signal generated by the sensor of FIG. 20 according to an example implementation.

Referring to FIG. 21 in conjunction with FIG. 20, as a more specific example, an example signal is depicted in FIG. 21 illustrating a signature 1302 of the combined signal (called the"$VD_{IFF}$" signal in FIG. 21) when the electromagnetic coupling sensor passes in proximity to an illustrated geometric feature 1220, such as an annular notch for this example.

Figure 22:
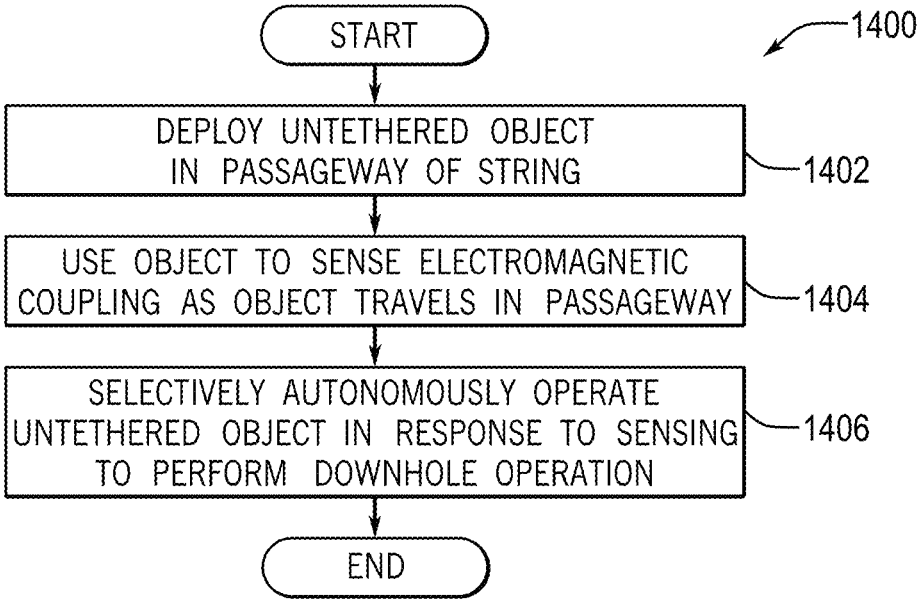

Thus, referring to FIG. 22, in accordance with example implementations, a technique 1400 includes deploying (block 1402) an untethered object and using (block 1404) the object to sense an electromagnetic coupling as the object travels in a passageway of the string with the in situ channelization treatment fluid, the energized in situ channelization treatment fluid, the pad substage fluid, the flush substage fluid, or another treatment fluid. The technique 1400 includes selectively autonomously operating the untethered object in response to the sensing to perform a downhole operation, pursuant to block 1406.

Thus, in general, implementations are disclosed herein for purposes of deploying an untethered object with the in situ channelization treatment fluid, the energized in situ channelization treatment fluid, the pad substage fluid, the flush substage fluid, or another treatment fluid, through a passageway of the string in a well and sensing a position indicator as the object is being communicated through the passageway. The untethered object selectively autonomously operates in response to the sensing. As disclosed above, the property may be a physical property such as a magnetic marker, an electromagnetic coupling, a geometric discontinuity, a pressure or a radioactive source. In further implementations, the physical property may be a chemical property or may be an acoustic wave. Moreover, in accordance with some implementations, the physical property may be a conductivity. In yet further implementations, a given position indicator may be formed from an intentionally-placed marker, a response marker, a radioactive source, magnet, microelectromechanical system (MEMS), a pressure, and so forth. The untethered object has the appropriate sensor(s) to detect the position indicator(s), as can be appreciated by the skilled artisan in view of the disclosure contained herein.

Other implementations are contemplated and are within the scope of the appended claims. For example, in accordance with further example implementations, the dart may have a container that contains a chemical (a tracer, for example) that is carried into the fractures with the fracturing fluid. In this manner, when the dart is deployed into the well, the chemical is confined to the container. The dart may contain a rupture disc (as an example), or other such device, which is sensitive to the tubing string pressure such that the disc ruptures at fracturing pressures to allow the chemical to leave the container and be transported into the fractures. The use of the chemical in this manner allows the recovery of information during flowback regarding fracture efficiency, fracture locations, and so forth.

As another example of a further implementation, the dart may contain a telemetry interface that allows wireless communication with the dart. For example, a tube wave, e.g., an acoustic wave, may be used to communicate with the dart from the earth surface, as an example, for purposes of acquiring information from the dart, e.g., information about the status of the dart, information acquired by the dart, and so forth. The wireless communication may also be used, for example, to initiate an action of the dart, such as, for example, instructing the dart to radially expand, radially contract, acquire information, transmit information to the surface, and so forth.

EXAMPLES

Any element in the examples may be replaced by any one of numerous equivalent alternatives, only some of which are disclosed in the specification. Although only a few example embodiments have been described in detail above, those skilled in the art will readily appreciate that many modifications are possible in the example embodiments without materially departing from the concepts described herein. The disclosed subject matter may be embodied in other forms without departing from the spirit and the essential attributes thereof, and, accordingly, reference should be made to the appended claims, rather than to the foregoing specification, as indicating the scope of the disclosed subject matter. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

Example 1 and Comparative Example 1

Formation of Proppant-rich Clusters and Proppant-free Channels by Enabling Heterogeneous Proppant Settling in the Presence of Anchor in an Energized Fluid The energized fluid as disclosed was laboratory tested using artificial voids created between two plates having a space there between. The simulated fracture width was 3 mm and the plates dimension were 15.2 cm by 20.3 cm (6 by 8 inches). As would be understood, other sizes of plates could be used. The plates were made from a transparent acrylic glass, so that the settling and distribution of the treatment slurry may be observed over time. Sandpaper (100 mesh) was glued to the back wall of the slot to provide roughness.

Figure 23:
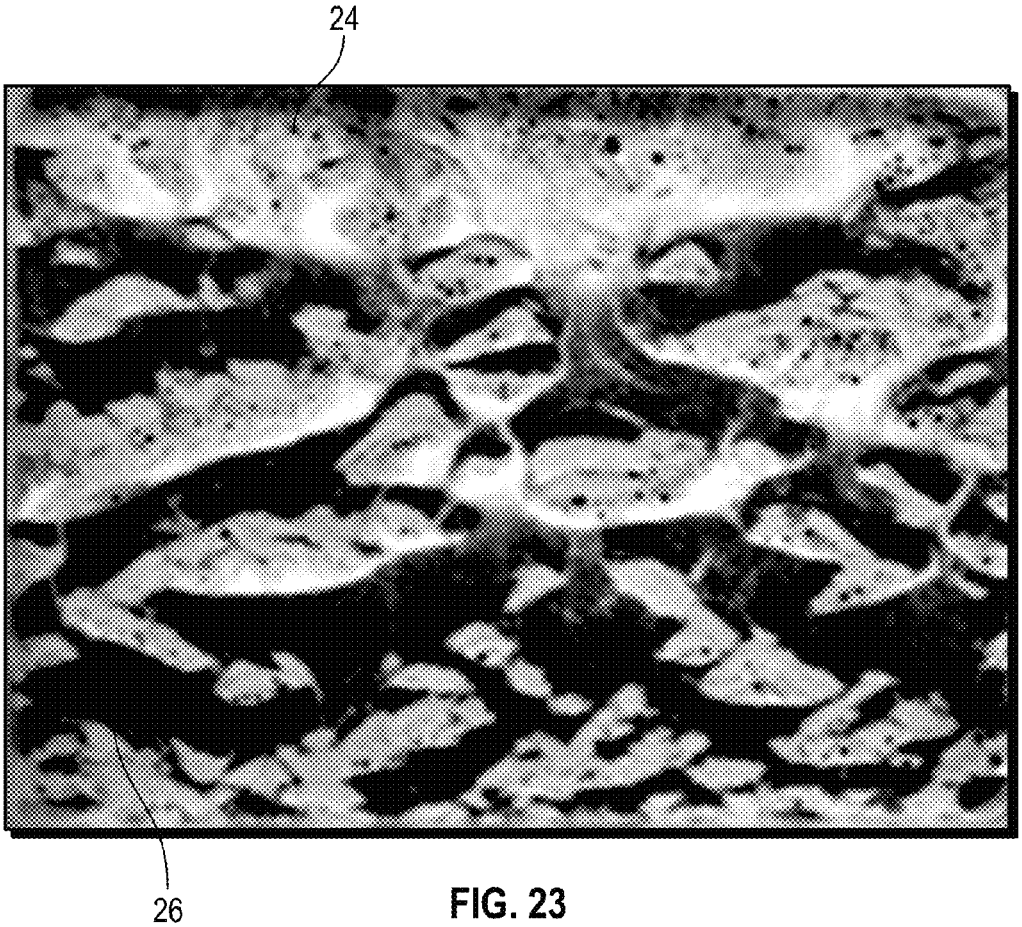
FIG. 23 illustrates a laboratory experiment evidencing the settling of proppant in a slot in fiber loaded foamed fluid.

In this example, a fluid formulation of 0.36% guar solution in water and 0.36 g/mL (3 ppa) of 20/40 mesh sand, 2.4 g/L (20 ppt) polylactide fiber (length 6 mm, diameter 12 microns), and 0.5 wt % of foaming agent (oxyalkylated alcohol) was introduced in the slot. Initially, the fluid appeared homogeneous. The slots were observed four hours later. As illustrated in FIG. 23, destabilization of the foam resulted in forming air bubbles 24, which were entrapped into the structure of the formed sand clusters 26, which were observed to have a significantly reduced settling rate.

While the disclosure has provided specific and detailed descriptions to various embodiments, the same is to be considered as illustrative and not restrictive in character. Only certain example embodiments have been shown and described. Those skilled in the art will appreciate that many modifications are possible in the example embodiments without materially departing from the disclosure. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary. In the claims, means-plus-function clauses are intended to cover the structures described herein as performing the recited function and not only structural equivalents, but also equivalent structures. For example, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

We claim:

1. A method, comprising:

placing in a wellbore adjacent a subterranean formation a downhole completion staging system production liner fitted with a plurality of sliding sleeves in the closed position;

placing into the wellbore a downhole completion staging system tool comprising a sleeve-shifting device, using an in situ channelization treatment fluid comprising solid particulates as a medium to transport the downhole completion staging system tool;

translating the downhole completion staging system tool into a capture feature of the downhole completion staging system to operate one or more of the sliding sleeves to open one or more fracturing ports for fluid communication between the wellbore and the subterranean formation in one of a plurality of wellbore stages spaced along the wellbore;

isolating the one of the wellbore stages for treatment;

injecting the in situ channelization treatment fluid through the wellbore and the one or more fracturing ports of the isolated wellbore stage to place particulate clusters in a fracture in the subterranean formation;

repeating the isolation and particulate clusters placement to treat one or more additional stages;

terminating treatment of the one or more stages with injection of a volume of a terminal flushing fluid substage substantially free of particles prior to treatment of a successive one of the additional stages, wherein the volume of the terminal flushing fluid substage is less than a volume of a flow path in the wellbore to the one or more stages.

2. The method of claim 1, wherein the downhole completion staging system tool comprises an untethered object.

3. The method of claim 2, wherein the downhole completion staging system tool is attached to a wireline to relay information from the tool to surface.

4. The method of claim 1, wherein the in situ channelization treatment fluid is circulated through the fracturing port and into the formation to create the fracture.

5. The method of claim 1, further comprising radially expanding the downhole completion staging system tool to form a plug between at least two stages.

6. The method of claim 1, further comprising sensing a property of an environment of the downhole completion staging system production liner, wherein the operation of the downhole completion staging system tool to open the one or more fracturing ports is autonomous in response to the sensing.

7. The method of claim 1, wherein the in situ channelization treatment fluid comprises a carrier fluid, proppant and an anchorant.

8. The method of claim 7, wherein the in situ channelization treatment fluid comprises a viscosified carrier fluid and a breaker to induce settling of the solid particulates prior to closure of the fracture.

9. The method of claim 7, wherein the in situ channelization treatment fluid is energized.

10. The method of claim 1, wherein the method is free of overflushing.

11. A method, comprising:

pushing an untethered object in a wellbore with an in situ channelization treatment fluid comprising proppant and anchorant;

autonomously operating the untethered object to sense a downhole location to transition the untethered object from a first state to a second state in response to the sensing;

triggering an activating feature of a downhole completion staging system responsive to the second transition state of the untethered object to open one or more fracturing ports for fluid communication between the wellbore and a subterranean formation in one of a plurality of wellbore stages spaced along the wellbore;

isolating the one of the wellbore stages for treatment;

injecting the in situ channelization treatment fluid through the opened one or more fracturing ports of the isolated wellbore stage to place particulate clusters in a fracture in the subterranean formation; and repeating the isolation and particulate clusters placement for one or more additional stages; and terminating treatment of the plurality of wellbore stages with injection of a volume of a terminal flushing fluid substage substantially free of particles prior to treatment of a successive one of the additional stages, wherein the volume of the terminal flushing fluid substage is less than a volume of a flow path in the wellbore to the plurality of wellbore stages.

12. The method of claim 11, wherein the first state comprises a radially contracted state and the second state comprises a radially expanded state.

13. The method of claim 12, wherein the activating feature comprises a capture feature and the isolation comprises forming a plug with the untethered object in the radially expanded state.

14. The method of claim 11, wherein the in situ channelization treatment fluid is circulated through the fracturing port and into the formation to create the fracture.

15. The method of claim 11, wherein the triggering of the activating feature of the downhole completion staging system to open the one or more fracturing ports comprises operating a sliding sleeve.

16. The method of claim 11, wherein the injection of the in situ channelization treatment fluid comprises forming within the fracture a homogeneous region of continuously uniform distribution of the proppant and thereafter aggregating the proppant to form the clusters in the fracture.

17. The method of claim 11, wherein the in situ channelization treatment fluid is energized.

18. The method of claim 11, further comprising producing a reservoir fluid from the fractures in the subterranean formation, wherein a production efficiency is at least 70 percent, wherein production efficiency is taken as a ratio of the number of producing wellbore treatment stages to a total number of wellbore treatment stages.

19. A downhole completion staging system, comprising:

a wellbore penetrating a subterranean formation and comprising a production liner fitted with a plurality of sliding sleeves;

a pumping system to inject an in situ channelization treatment fluid comprising solid particulates into the wellbore;

a plurality of completion staging system tools for deployment into the wellbore with the in situ channelization treatment fluid, the completion staging system tools comprising a sleeve-shifting device;

the sliding sleeve valves each comprising a capture feature to receive a respective one of the completion staging system tools to open one or more fracturing ports for fluid communication between the wellbore and the subterranean formation in one of a plurality of wellbore stages spaced along the wellbore;

a plurality of plugs operable to successively isolate respective ones of the wellbore stages for treatment comprising injecting the in situ channelization treatment fluid through the one or more fracturing ports of the isolated wellbore stage to place particulate clusters in fractures in the subterranean formation in a plurality of the stages; and a plurality of volumes of a terminal flushing fluid substage substantially free of particles, wherein the volume of each terminal flushing fluid substage is less than a volume of a flow path in the wellbore to the one or more stages.

20. The system of claim 19, wherein the in situ channelization treatment fluid is a transport medium for the completion staging system tools.

21. The system of claim 19, wherein the downhole completion staging system tools are radially expandable to form the plugs.

22. The system of claim 19, wherein the downhole completion staging system tools comprise untethered objects comprising sensors to sense a property of an environment of the production liner, wherein the downhole completion staging system tools are operable to autonomously open the fracturing ports in response to the sensing.

23. The system of claim 22, wherein the untethered objects comprise darts.

24. The system of claim 22, wherein the downhole completion staging system tools are connected to a wireline to relay information from the tool to surface.

25. The system of claim 19, wherein the in situ channelization treatment fluid comprises a carrier fluid, proppant and an anchorant.

26. The system of claim 25, wherein the in situ channelization treatment fluid comprises a viscosified carrier fluid and a breaker to induce settling of the solid particulates prior to closure of the fracture.

27. The system of claim 25, wherein the in situ channelization treatment fluid is energized.

28. A system, comprising:

an object deployed in a wellbore with an in situ channelization treatment fluid comprising proppant and anchorant;

a sensor in the object to autonomously operate the object to sense a downhole location to transition the object from a first state to a second state in response to the sensing;

an activating feature of a downhole completion staging system responsive to be triggered by the second transition state of the object to open one or more fracturing ports for fluid communication between the wellbore and a subterranean formation in one of a plurality of wellbore stages spaced along the wellbore;

the object comprising an isolation feature to isolate the one of the wellbore stages for treatment;

a pumping system to inject the in situ channelization treatment fluid through the opened one or more fracturing ports of the isolated wellbore stage to place particulate clusters in a fracture in the subterranean formation; and an additional one or more of the objects to repeat the isolation and particulate clusters placement for a respective one or more additional stages;

terminating treatment of the plurality of wellbore stages with injection of a volume of a terminal flushing fluid substage substantially free of particles prior to treatment of the additional stages, wherein the volume of the terminal flushing fluid substage is less than a volume of a flow path in the wellbore to the plurality of wellbore stages.

29. The system of claim 28, wherein the object comprises an untethered object, the first state comprises a radially contracted state and the second state comprises a radially expanded state.

30. The system of claim 29, wherein the activating feature comprises a capture feature and the isolation feature comprises a plug formed by the object in the radially expanded state.

31. The system of claim 29, comprising a plurality of the fractures formed by injecting the in situ channelization treatment fluid with the pumping system through the fracturing port and into the formation.

32. The system of claim 28, wherein the activating feature to open the one or more fracturing ports comprises a sliding sleeve.

33. The system of claim 28, wherein the in situ channelization treatment fluid comprises a trigger to initiate aggregation of the proppant to form the clusters.

34. The system of claim 28, wherein the in situ channelization treatment fluid is energized.

35. The system of claim 28 installed to produce a reservoir fluid from the fractures in the subterranean formation from a plurality of the wellbore treatment stages.

36. The system of claim 35, comprising a production efficiency of at least 70 percent, wherein production efficiency is taken as a ratio of the number of producing wellbore treatment stages to a total number of wellbore treatment stages.

* * * * *